US007792679B2

(12) United States Patent
Virette et al.

(10) Patent No.: US 7,792,679 B2
(45) Date of Patent: Sep. 7, 2010

(54) OPTIMIZED MULTIPLE CODING METHOD

(75) Inventors: David Virette, Pleumeur Bodou (FR); Claude Lamblin, Perros Guirec (FR); Abdellatif Benjelloun Touimi, Lannion (FR)

(73) Assignee: France Telecom, Paris (FR)

( * ) Notice: Subject to any disclaimer, the term of this patent is extended or adjusted under 35 U.S.C. 154(b) by 278 days.

(21) Appl. No.: 10/582,025

(22) PCT Filed: Nov. 24, 2004

(86) PCT No.: PCT/FR2004/003009

§ 371 (c)(1),
(2), (4) Date: Jun. 8, 2006

(87) PCT Pub. No.: WO2005/066938

PCT Pub. Date: Jul. 21, 2005

(65) Prior Publication Data

US 2007/0150271 A1 Jun. 28, 2007

(30) Foreign Application Priority Data

Dec. 10, 2003 (FR) ..... 03 14490

(51) Int. Cl.
*G10L 19/00* (2006.01)

(52) U.S. Cl. ..... 704/500; 704/501; 704/201; 704/E19.044; 370/254

(58) Field of Classification Search ..... 704/207, 704/504, 501, 503, E19.049, 230, E19.015, 704/E19.017; 375/E7.198
See application file for complete search history.

(56) References Cited

U.S. PATENT DOCUMENTS

| | | | | | |
|---|---|---|---|---|---|
| 5,224,167 | A * | 6/1993 | Taniguchi et al. | ..... | 704/219 |
| 5,495,555 | A * | 2/1996 | Swaminathan | ..... | 704/207 |
| 5,596,676 | A * | 1/1997 | Swaminathan et al. | ..... | 704/208 |
| 5,729,655 | A * | 3/1998 | Kolesnik et al. | ..... | 704/223 |
| 5,987,506 | A * | 11/1999 | Carter et al. | ..... | 709/213 |
| 6,141,638 | A * | 10/2000 | Peng et al. | ..... | 704/211 |
| 6,173,257 | B1 * | 1/2001 | Gao | ..... | 704/220 |
| 6,192,335 | B1 * | 2/2001 | Ekudden et al. | ..... | 704/223 |
| 6,249,758 | B1 * | 6/2001 | Mermelstein | ..... | 704/220 |
| 6,487,535 | B1 * | 11/2002 | Smyth et al. | ..... | 704/500 |
| 6,526,140 | B1 | 2/2003 | Marchok et al. | | |

(Continued)

OTHER PUBLICATIONS

S. A. Ramprashad "A multimode transform predictive coder (MTPC) for speech and audio," Proc. IEEE Workshop on Speech Coding for Telecom. (Porvoo, Finland), pp. 10-12, Jun. 1999.*

(Continued)

*Primary Examiner*—Richemond Dorvil
*Assistant Examiner*—Greg A Borsetti
(74) *Attorney, Agent, or Firm*—Drinker Biddle & Reath LLP

(57) ABSTRACT

The invention relates to the compression coding of digital signals such as multimedia signals (audio or video), and more particularly a method for multiple coding, wherein several encoders each comprising a series of functional blocks receive an input signal in parallel. Accordingly, a method is provided in which, a) the functional blocks forming each encoder are identified, along with one or several functions carried out of each block, b) functions which are common to various encoders are itemized and c) said common functions are carried out definitively for a part of at least all of the encoders within at least one same calculation module.

29 Claims, 8 Drawing Sheets

U.S. PATENT DOCUMENTS

| | | | | |
|---|---|---|---|---|
| 6,532,593 | B1 * | 3/2003 | Moroney | 725/142 |
| 6,581,032 | B1 * | 6/2003 | Gao et al. | 704/222 |
| 6,604,070 | B1 * | 8/2003 | Gao et al. | 704/222 |
| 6,640,209 | B1 * | 10/2003 | Das | 704/219 |
| 6,658,383 | B2 * | 12/2003 | Koishida et al. | 704/229 |
| 6,658,605 | B1 * | 12/2003 | Yoshida et al. | 714/702 |
| 6,691,084 | B2 * | 2/2004 | Manjunath et al. | 704/221 |
| 6,757,649 | B1 * | 6/2004 | Gao et al. | 704/222 |
| 6,829,579 | B2 * | 12/2004 | Jabri et al. | 704/221 |
| 6,961,698 | B1 * | 11/2005 | Gao et al. | 704/229 |
| 7,023,880 | B2 * | 4/2006 | El-Maleh et al. | 370/466 |
| 7,095,343 | B2 * | 8/2006 | Xie et al. | 341/107 |
| 7,116,653 | B1 * | 10/2006 | Bemmer et al. | 370/335 |
| 7,136,812 | B2 * | 11/2006 | Manjunath et al. | 704/221 |
| 7,146,311 | B1 * | 12/2006 | Uvliden et al. | 704/219 |
| 7,167,828 | B2 * | 1/2007 | Ehara | 704/223 |
| 7,200,561 | B2 * | 4/2007 | Moriya et al. | 704/500 |
| 7,254,533 | B1 * | 8/2007 | Jabri et al. | 704/219 |
| 7,257,157 | B2 * | 8/2007 | Cheung | 375/240 |
| 7,263,481 | B2 * | 8/2007 | Jabri et al. | 704/219 |
| 7,272,556 | B1 * | 9/2007 | Aguilar et al. | 704/230 |
| 7,305,055 | B1 * | 12/2007 | Gardner et al. | 375/347 |
| 7,433,815 | B2 * | 10/2008 | Jabri et al. | 704/203 |
| 7,469,209 | B2 * | 12/2008 | Chong-White et al. | 704/229 |
| 7,472,056 | B2 * | 12/2008 | Sung et al. | 704/200.1 |
| 7,574,354 | B2 * | 8/2009 | Lamblin et al. | 704/223 |
| 2001/0016817 | A1 * | 8/2001 | Dejaco | 704/264 |
| 2002/0077812 | A1 * | 6/2002 | Suzuki et al. | 704/230 |
| 2002/0101369 | A1 * | 8/2002 | Gottesman | 341/94 |
| 2002/0119803 | A1 * | 8/2002 | Bitterlich et al. | 455/552 |
| 2004/0044524 | A1 * | 3/2004 | Minde et al. | 704/220 |
| 2004/0158463 | A1 * | 8/2004 | Jabri et al. | 704/219 |
| 2004/0174984 | A1 * | 9/2004 | Jabri et al. | 379/386 |
| 2005/0075873 | A1 * | 4/2005 | Makinen | 704/230 |
| 2005/0100005 | A1 * | 5/2005 | Gibbs et al. | 370/357 |
| 2005/0258983 | A1 * | 11/2005 | Jabri et al. | 341/50 |

OTHER PUBLICATIONS

A. Das and A. Gersho, Low-rate multimode multiband spectral coding of speech, Int. J. Speech Tech. 2(4): 317-327 (1999).*

Seo, Seongho / Jang, Dalwon / Lee, Sunil / Yoo, Chang D. (2003): "A novel transcoding algorithm for SMV and g.723.1 speech coders via direct parameter transformation", In EUROSPEECH-Sep. 1-4, 2003, 2861-2864.*

Kim et al. "An Efficient Transcoding Algorithm for G.723.1 and EVRC Speech Coders" 2001.*

Otta et al. "Speech Coding Translating for IP and 3g Mobile Integrated Network" 2002.*

Tsai et al. "GSM to G.729 Speech Transcoder" 2001.*

Kang et al. "Improving the Transcoding Capability of Speech Coders." Mar. 2003.*

Lee et al. "A Novel Transcoding Algorithm for AMR and EVRC Speech Codecs Via Direct Parameter Transformation" 2003.*

M. Ghenania and C. Lamblin, "Low-cost smart transcoding algorithm between ITU-T G.729 (8 kbit/s) and 3GPP NB-AMR (12.2 kbit/s)," in EUSIPCO, 2004.*

Yoon et al. "An Efficient Transcoding Algorithm for G.723.1 and G.729A Speech Coders" 2001.*

Yoon et al. "Transcoding Algorithm for G.723.1 and AMR Speech Coders: for Interoperability between VoIP and Mobile Networks" 2003.*

* cited by examiner

OPTIMIZED MULTIPLE CODING METHOD

CROSS-REFERENCE TO RELATED APPLICATIONS

This application is the U.S. national phase of the International Patent Application No. PCT/FR2004/003009 filed Nov. 24, 2004, which claims the benefit of French Application No. 03 14490 filed Dec. 10, 2003, the entire content of which is incorporated herein by reference.

FIELD OF THE INVENTION

The present invention relates to coding and decoding digital signals in applications that transmit or store multimedia signals such as audio (speech and/or sound) signals or video signals.

BACKGROUND OF THE INVENTION

To offer mobility and continuity, modern and innovative multimedia communication services must be able to function under a wide variety of conditions. The dynamism of the multimedia communication sector and the heterogeneous nature of networks, access points, and terminals have generated a proliferation of compression formats.

The present invention relates to optimization of the "multiple coding" techniques used when a digital signal or a portion of a digital signal is coded using more than one coding technique. The multiple coding may be simultaneous (effected in a single pass) or non-simultaneous. The processing may be applied to the same signal or to different versions derived from the same signal (for example with different bandwidths). Thus, "multiple coding" is distinguished from "transcoding", in which each coder compresses a version derived from decoding the signal compressed by the preceding coder.

One example of multiple coding is coding the same content in more than one format and then transmitting it to terminals that do not support the same coding formats. In the case of real-time broadcasting, the processing must be effected simultaneously. In the case of access to a database, the coding could be effected one by one, and "offline". In these examples, multiple coding is used to code the same signal with different formats using a plurality of coders (or possibly a plurality of bit rates or a plurality of modes of the same coder), each coder operating independently of the others.

Another use of multiple coding is encountered in coding structures in which a plurality of coders compete to code a signal segment, only one of the coders being finally selected to code that segment. That coder may be selected after processing the segment, or even later (delayed decision). This type of structure is referred to below as a "multimode coding" structure (referring to the selection of a coding "mode"). In these multimode coding structures, a plurality of coders sharing a "common past" code the same signal portion. The coding techniques used may be different or derived from a single coding structure. They will not be totally independent, however, except in the case of "memoryless" techniques. In the (routine) situation of coding techniques using recursive processing, the processing of a given signal segment depends on how the signal has been coded in the past. There is therefore some coder interdependency, when a coder has to take account in its memories of the output from another coder.

The concept of "multiple coding" and conditions for using such techniques have been introduced in the various contexts referred to above. The complexity of implementation may prove insurmountable, however.

For example, in the situation of content servers that broadcast the same content with different formats adapted to the access conditions, networks, and terminals of different clients, this operation becomes extremely complex as the number of formats required increases. In the case of real-time broadcasting, as the various formats are coded in parallel, a limitation is rapidly imposed by the resources of the system.

The second use referred to above relates to multimode coding applications that select one coder from a set of coders for each signal portion analyzed. Selection requires the definition of a criterion, the more usual criteria aiming to optimize the bit rate/distortion trade-off. The signal being analyzed over successive time segments, a plurality of codings are evaluated in each segment. The coding with the lowest bit rate for a given quality or the best quality for a given bit rate is then selected. Note that constraints other than those of bit rate and distortion may be used.

In such structures, the coding is generally selected a priori by analyzing the signal over the segment concerned (selection according to the characteristics of the signal). However, the difficulty of producing a robust classification of the signal for the purposes of this selection has led to the proposal for a posteriori selection of the optimum mode after coding all the modes, although this is achieved at the cost of high complexity.

Intermediate methods combining the above two approaches have been proposed with a view to reducing the computation cost. Such strategies are less than the optimum, however, and offer worse performance than exploring all the modes. Exploring all the modes or a major portion of the modes constitutes a multiple coding application that is potentially highly complex and not readily compatible a priori with real-time coding, for example.

At present, most multiple coding and transcoding operations take no account of interaction between formats and between the format and its content. A few multimode coding techniques have been proposed but the decision as to the mode to use is generally effected a priori, either on the signal (by classification, as in the SMV coder (selectable mode vocoder), for example, or as a function of the conditions of the network (as in adaptive multirate (AMR) coders, for example).

Various selection modes are described in the following documents, in particular decision controlled by the source and decision controlled by the network:

"An overview of variable rate speech coding for cellular networks", Gersho, A.; Paksoy, E.; Wireless Communications, 1992. Conference Proceedings, 1992 IEEE International Conference on Selected Topics, 25-26 Jun. 1992 Page(s): 172-175;

"A variable rate speech coding algorithm for cellular networks", Paksoy, E.; Gersho, A.; Speech Coding for Telecommunications, 1993. Proceedings, IEEE Workshop 1993, Page(s): 109-110; and "Variable rate speech coding for multiple access wireless networks", Paksoy E.; Gersho A.; Proceedings, 7th Mediterranean Electrotechnical Conference, 12-14 Apr. 1994 Page(s): 47-50 vol. 1.

In the case of a decision controlled by the source, the a priori decision is made on the basis of a classification of the input signal. There are many methods of classifying the input signal.

In the case of a decision controlled by the network, it is simpler to provide a multimode coder whose bit rate is selected by an external module rather than by the source. The simplest method is to produce a family of coders each of fixed bit rate but with different coders having different bit rates and to switch between those bit rates to obtain a required current mode.

Work has also been done on combining a plurality of criteria for a priori selection of the mode to be used; see in particular the following documents:

"Variable-rate for the basic speech service in UMTS" Berruto, E.; Sereno, D.; Vehicular Technology Conference, 1993 IEEE 43rd, 18-20 May 1993 Page(s): 520-523; and "A VR-CELP codec implementation for CDMA mobile communications" Cellario, L.; Sereno, D.; Giani, M.; Blocher, P.; Hellwig, K.; Acoustics, Speech, and Signal Processing, 1994, ICASSP-94, 1994 IEEE International Conference, Volume: 1, 19-22 Apr. 1994 Page(s): I/281-I/284 vol. 1.

All multimode coding algorithms using a priori coding mode selection suffer from the same drawback, related in particular to problems with the robustness of a priori classification.

For this reason techniques have been proposed using an a posteriori decision as to the coding mode. For example, in the following document:

"Finite state CELP for variable rate speech coding" Vaseghi, S. V.; Acoustics, Speech, and Signal Processing, 1990, ICASSP-90, 1990 International Conference, 3-6 Apr. 1990 Page(s): 37-40 vol. 1, the coder can switch between different modes by optimizing an objective quality measurement with the result that the decision is made a posteriori as a function of the characteristics of the input signal, the target signal-to-quantization noise ratio (SQNR), and the current status of the coder. A coding scheme of this kind improves quality. However, the different codings are carried out in parallel and the resulting complexity of this type of system is therefore prohibitive.

Other techniques have been proposed combining an a priori decision and closed loop improvement. In the document:

"Multimode variable bit rate speech coding: an efficient paradigm for high-quality low-rate representation of speech signal" Das, A.; DeJaco, A.; Manjunath, S.; Ananthapadmanabhan, A.; Huang, J.; Choy, E.; Acoustics, Speech, and Signal Processing, 1999. ICASSP '99 Proceedings, 1999 IEEE International Conference, Volume: 4, 15-19 Mar. 1999 Page(s): 2307-2310 vol. 4, the proposed system effects a first selection (open loop selection) of the mode as a function of the characteristics of the signal. This decision may be effected by classification. Then, if the performance of the selected mode is not satisfactory, on the basis of an error measurement, a higher bit rate mode is applied and the operation is repeated (closed loop decision).

Similar techniques are described in the following documents:

"Variable rate speech coding for UMTS" Cellario, L.; Sereno, D.; Speech Coding for Telecommunications, 1993. Proceedings, IEEE Workshop, 1993 Page(s): 1-2.

"Phonetically-based vector excitation coding of speech at 3.6 kbps" Wang, S.; Gersho, A.; Acoustics, Speech, and Signal Processing, 1989. ICASSP-89, 1989 International Conference, 23-26 May 1989 Page(s): 49-52 vol. 1.

"A modified CS-ACELP algorithm for variable-rate speech coding robust in noisy environments" Beritelli, F.; IEEE Signal Processing Letters, Volume: 6 Issue: 2, Feb. 1999 Page(s): 31-34.

An open loop first selection is effected after classification of the input signal (phonetic or voiced/non-voiced classification), after which a closed loop decision is made:

- either over the complete coder, in which case the whole speech segment is coded again;
- or over a portion of the coding, as in the above references preceded by an asterisk (*), in which case the dictionary to be used is selected by a closed loop process.

All of the work referred to above seeks to solve the problem of the complexity of the optimum mode selection by the total or partial use of an a priori selection or preselection that avoids multiple coding or reduces the number of coders to be used in parallel.

However, no prior art technique has ever been proposed that reduces coding complexity.

SUMMARY OF THE INVENTION

The present invention seeks to improve on this situation.

To this end it proposes a multiple compression coding method in which an input signal feeds in parallel a plurality of coders each including a succession of functional units with a view to compression coding of said signal by each coder.

The method of the invention includes the following preparatory steps:

a) identifying the functional units forming each coder and one or more functions implemented by each unit;

b) marking functions that are common from one coder to another; and c) executing said common functions once and for all for at least some of the coders in a common calculation module.

In an advantageous embodiment of the invention, the above steps are executed by a software product including program instructions to this effect. In this regard, the present invention is also directed to a software product of the above kind adapted to be stored in a memory of a processor unit, in particular a computer or a mobile terminal, or in a removable memory medium adapted to cooperate with a reader of the processor unit.

The present invention is also directed to a compression coding aid system for implementing the method of the invention and including a memory adapted to store instructions of a software product of the type cited above.

BRIEF DESCRIPTION OF THE DRAWINGS

Other features and advantages of the invention become apparent on reading the following detailed description and examining the appended drawings, in which.

MORE DETAILED DESCRIPTION

Figure 1A:
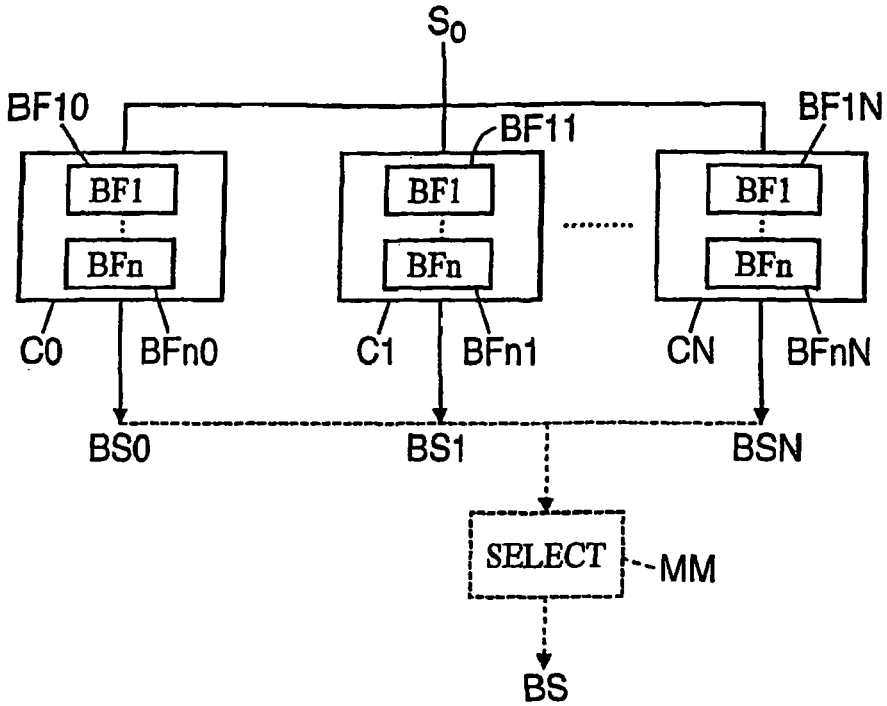
FIG. 1*a* is a diagram of the application context of the present invention, showing a plurality of coders disposed in parallel.

Refer first to FIG. 1*a*, which represents a plurality of coders C0, C1, . . . , CN in parallel each receiving an input signal $s_0$. Each coder comprises functional units BF1 to BFn for implementing successive coding steps and finally delivering a coded bit stream BS0, BS1, . . . , BSN. In a multimode coding application, the outputs of the coders C0 to CN are connected to an optimum mode selector module MM and it is the bit stream BS from the optimum coder that is forwarded (dashed arrows in FIG. 1*a*).

For simplicity, all the coders in the FIG. 1*a* example have the same number of functional units, but it must be understood that in practice not all these functional units are necessarily provided in all the coders.

Some functional units BFi are sometimes identical from one mode (or coder) to another; others differ only at the level of the layers that are quantized. Usable relations also exist when using coders from the same coding family employing similar models or calculating parameters linked physically to the signal.

The present invention aims to exploit these relations to reduce the complexity of multiple coding operations.

The invention proposes firstly to identify the functional units constituting each of the coders. The technical similarities between the coders are then exploited by considering functional units whose functions are equivalent or similar. For each of those units, the invention proposes:

- to define "common" operations and to effect them once only for all the coders; and
- to use calculation methods specific to each coder and in particular using the results of the aforementioned common calculations. These calculation methods produce a result that may be different from that produced by complete coding. The object is then in fact to accelerate the processing by exploiting available information supplied in particular by the common calculations. Methods like these for accelerating the calculations are used in techniques for reducing the complexity of transcoding operations, for example (known as "intelligent transcoding" techniques).

Figure 1B:
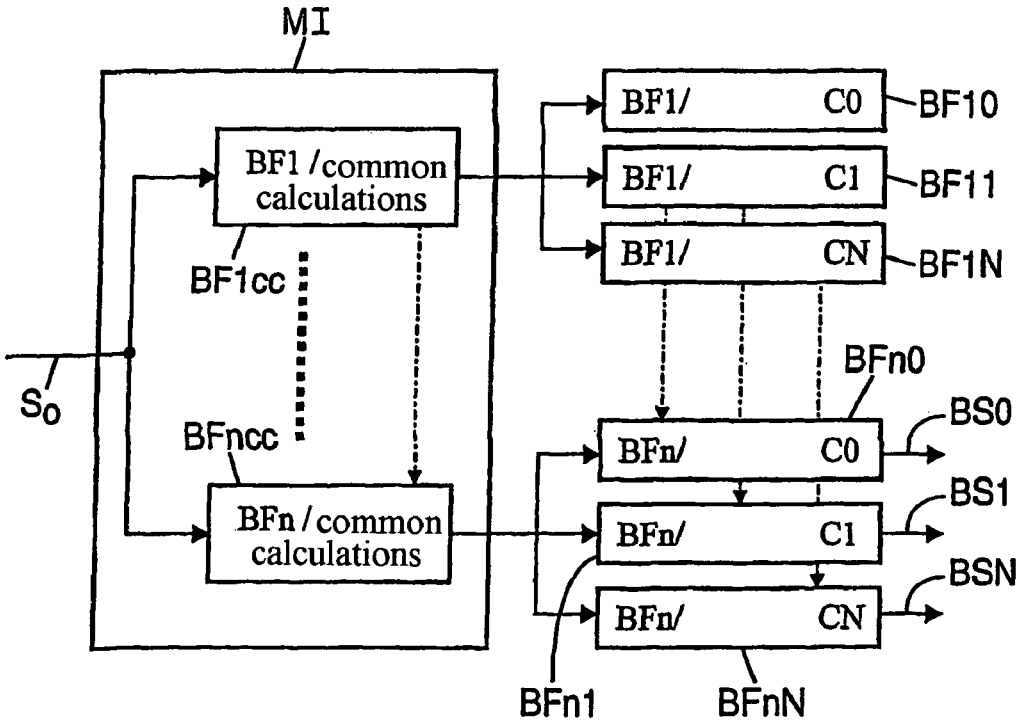
FIG. 1*b* is a diagram of an application of the invention with functional units shared between a plurality of coders disposed in parallel.

FIG. 1*b* shows the proposed solution. In the present example, the "common" operations cited above are effected once only for at least some of the coders and preferably for all the coders in an independent module MI that redistributes the results obtained to at least some of the coders or preferably to all the coders. It is therefore a question of sharing the results obtained between at least some of the coders C0 to CN (this is referred to below as "mutualization"). An independent module MI of the above kind may form part of a multiple compression coding aid system as defined above.

In an advantageous variant, rather than using an external calculation module MI, the existing functional unit or units BF1 to BFn of the same coder or a plurality of separate coders are used, the coder or coders being selected in accordance with criteria explained later.

The present invention may employ a plurality of strategies which may naturally differ according to the role of the functional unit concerned.

A first strategy uses the parameters of the coder having the lowest bit rate to focus the parameter search for all the other modes.

A second strategy uses the parameters of the coder having the highest bit rate and then "downgrades" progressively to the coder having the lowest bit rate.

Of course, if preference is to be given to a particular coder, it is possible to code a signal segment using that coder and then to reach coders of higher and lower bit rate by applying the above two strategies.

Of course, criteria other than the bit rate can be used to control the search. For some functional units, for example, preference may be given to the coder whose parameters lend themselves best to efficient extraction (or analysis) and/or coding of similar parameters of the other coders, efficacy being judged according to complexity or quality or a trade-off between the two.

An independent coding module not present in the coders but enabling more efficient coding of the parameters of the functional unit concerned for all the coders may also be created.

The various implementation strategies are particularly beneficial in the case of multimode coding. In this context, shown in FIG. 1*c*, the present invention reduces the complexity of the calculations preceding the a posteriori selection of a coder effected in the final step, for example by the final module MM prior to forwarding the bit stream BS.

Figure 1C:
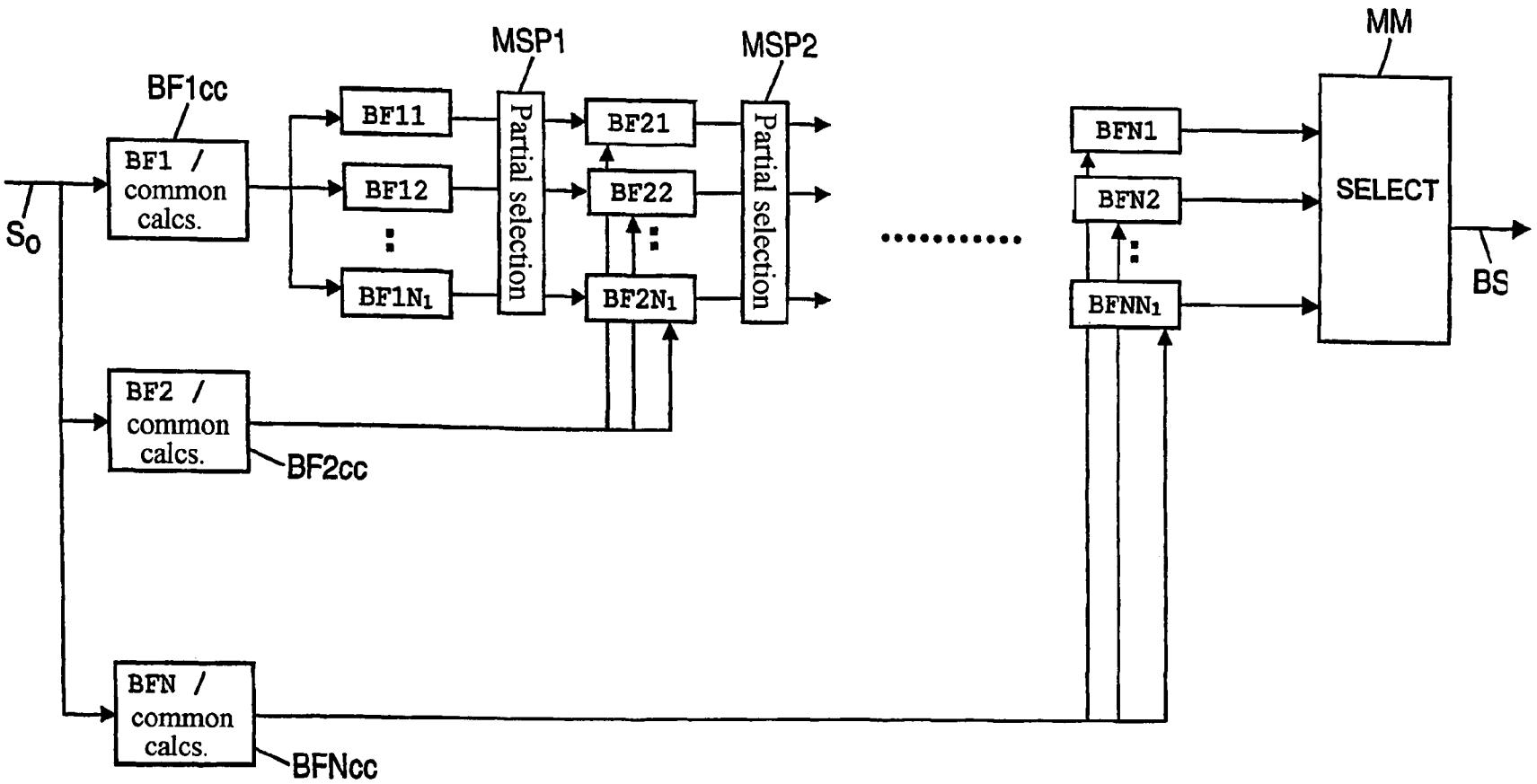
FIG. 1*c* is a diagram of an application of the invention with functional units shared in multimode coding.

In this particular case of multimode coding, a variant of the present invention represented in FIG. 1*c* introduces a partial selection module MSPi (where i=1, 2, . . . , N) after each coding step (and thus after the functional units BFi1 to $BFiN_1$ which compete with each other and whose result for the selected block(s) BFicc will be used afterwards). Thus the similarities of the different modes are exploited to accelerate the calculation of each functional unit. In this case not all the coding schemes will necessarily be evaluated.

Figure 1D:
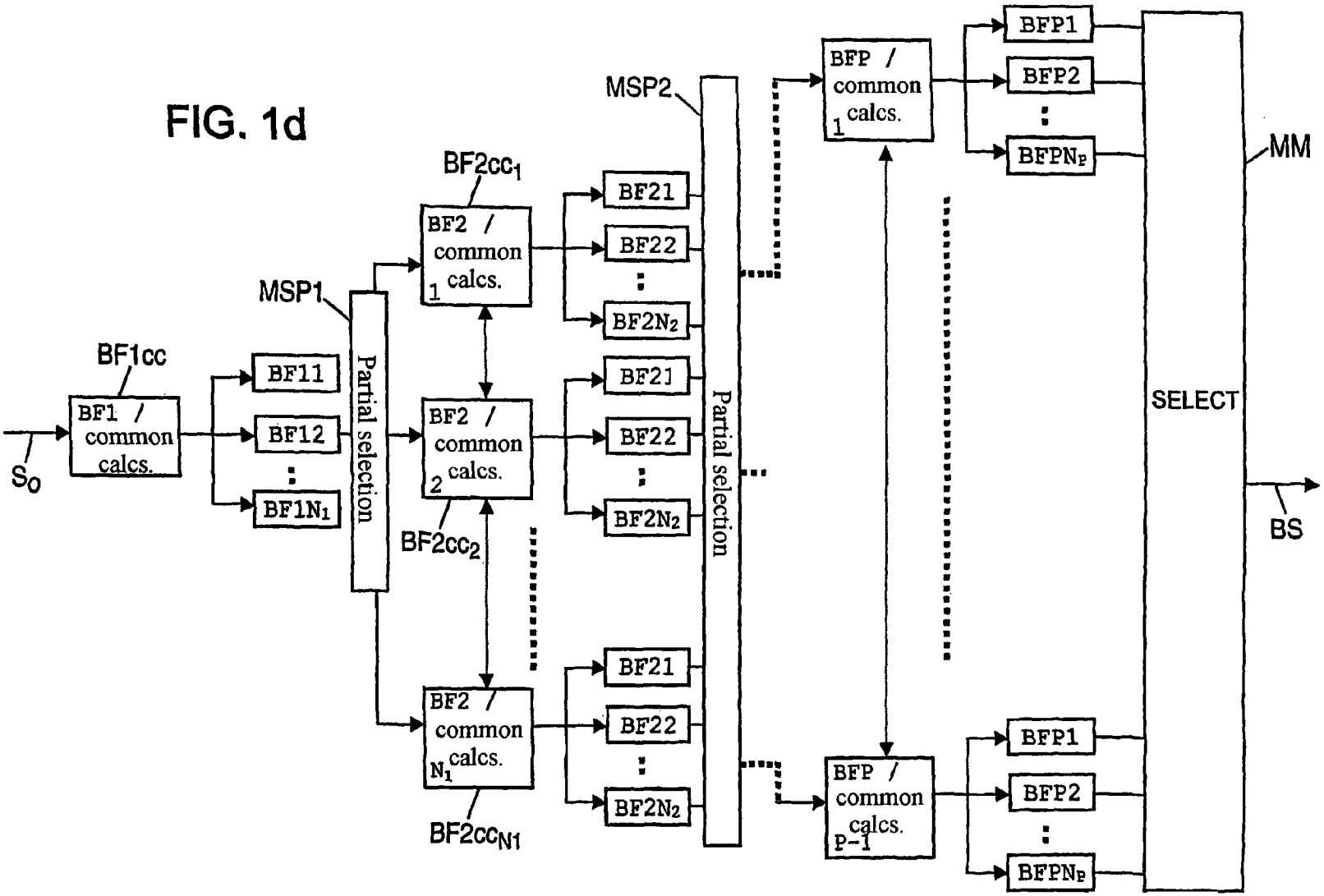
FIG. 1*d* is a diagram of an application of the invention to multimode trellis coding.

A more sophisticated variant of the multimode structure based on the division into functional units described above is described next with reference to FIG. 1*d*. The multimode structure of FIG. 1*d* is a "trellis" structure offering a plurality of possible paths through the trellis. In fact, FIG. 1*d* shows all the possible paths through the trellis, which therefore has a tree shape. Each path of the trellis is defined by a combination of operating modes of the functional units, each functional unit feeding a plurality of possible variants of the next functional unit.

Thus each coding mode is derived from the combination of operating modes of the functional units: functional unit 1 has $N_1$ operating modes, functional unit 2 has $N_2$, and so on up to unit P. The combination of the $NN=N_1 \times N_2 \times \ldots \times N_p$ possible combinations is therefore represented by a trellis with NN branches defining, end-to-end, a complete multimode coder with NN modes. Some branches of the trellis may be eliminated a priori to define a tree having a reduced number of branches. A first particular feature of this structure is that, for a given functional unit, it provides a common calculation module for each output of the preceding functional unit. These common calculation modules carry out the same operations, but on different signals, since they come from different previous units. The common calculation modules of the same level are advantageously mutualized: the results from a given module usable by the subsequent modules are supplied to those subsequent modules. Secondly, partial selection following the processing of each functional unit advantageously enables the elimination of branches offering the lowest performance against the selected criterion. Thus the number of branches of the trellis to be evaluated may be reduced.

One advantageous application of this multimode trellis structure is as follows.

If the functional units are liable to operate at respective different bit rates using respective parameters specific to said bit rates, for a given functional unit, the path of the trellis selected is that through the functional unit with the lowest bit rate or that through the functional unit with the highest bit rate, according to the coding context, and the results obtained from the functional unit with the lowest (or highest) bit rate are adapted to the bit rates of at least some of the other functional units through a focused parameter search for at least some of the other functional units, up to the functional unit with the highest (respectively lowest) bit rate.

Alternatively, a functional unit of given bit rate is selected and at least some of the parameters specific to that functional unit are adapted progressively, by focused searching:

up to the functional unit capable of operating at the lowest bit rate; and up to the functional unit capable of operating at the highest bit rate.

This generally reduces the complexity associated with multiple coding.

The invention applies to any compression scheme using multiple coding of multimedia content. Three embodiments are described below in the field of audio (speech and sound) compression. The first two embodiments relate to the family of transform coders, to which the following reference document relates:

"Perceptual Coding of Digital Audio", Painter, T.; Spanias, A.; Proceedings of the IEEE, Vol. 88, No 4, April 2000.

The third embodiment relates to CELP coders, to which the following reference document relates:

"Code Excited Linear Prediction (CELP): High quality speech at very low bit rates" Schroeder M. R.; Atal B. S.; Acoustics, Speech, and Signal Processing, 1985. Proceedings. 1985 IEEE International Conference, Page(s): 937-940.

A summary of the main characteristics of these two coding families is given first.

Transform or Sub-Band Coders

Figure 2:
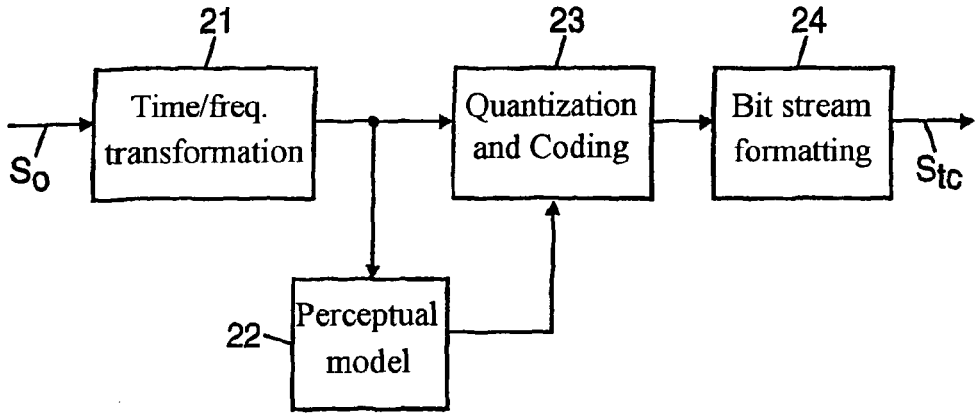
FIG. 2 is a diagram of the main functional units of a perceptual frequency coder.

These coders are based on psycho-acoustic criteria and transform blocks of the signal in the time domain to obtain a set of coefficients. The transforms are of the time-frequency type, one of the most widely used transforms being the modified discrete cosine transform (MDCT). Before the coefficients are quantized, an algorithm assigns bits so that the quantizing noise is as inaudible as possible. Bit assignment and coefficient quantization use a masking curve obtained from a psycho-acoustic model used to evaluate, for each line of the spectrum considered, a masking threshold representing the amplitude necessary for a sound at that frequency to be audible. FIG. 2 is a block diagram of a frequency domain coder. Note that its structure in the form of functional units is clearly shown. Referring to FIG. 2, the main functional units are:

a unit 21 for effecting the time/frequency transform on the input digital audio signal so;

a unit 22 for determining a perceptual model from the transformed signal;

a quantizing and coding unit 23 operating on the conceptual model; and a unit 24 for formatting the bit stream to obtain a coded audio stream $s_{tc}$.

Analysis by Synthesis Coders (CELP Coding)

Figure 3:
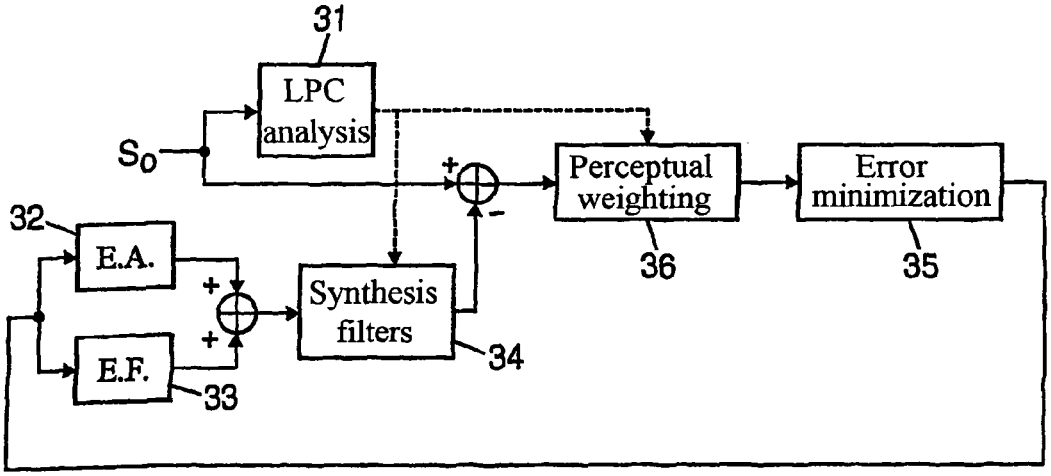
FIG. 3 is a diagram of the main functional units of an analysis by synthesis coder.

In coders of the analysis by synthesis type, the coder uses the synthesis model of the reconstructed signal to extract the parameters modeling the signals to be coded. Those signals may be sampled at a frequency of 8 kilohertz (kHz) (300-3400 hertz (Hz) telephone band) or at higher frequency, for example at 16 kHz for broadened band coding (bandwidth from 50 Hz to 7 kHz). Depending on the application and the required quality, the compression ratio varies from 1 to 16. These coders operate at bit rates from 2 kilobits per second (kbps) to 16 kbps in the telephone band and from 6 kbps to 32 kbps in the broadened band. FIG. 3 shows the main functional units of a CELP digital coder, which is the analysis by synthesis coder most widely used at present. The speech signal so is sampled and converted into a series of frames containing L samples. Each frame is synthesized by filtering a waveform extracted from a directory (also called a "dictionary") multiplied by a gain via two filters varying in time. The fixed excitation dictionary is a finite set of waveforms of the L samples. The first filter is a long-term prediction (LTP) filter. An LTP analysis evaluates the parameters of this long-term predictor, which exploits the periodic nature of voiced sounds, the harmonic component being modeled in the form of an adaptive dictionary (unit 32). The second filter is a short-term prediction filter. Linear prediction coding (LPC) analysis methods are used to obtain short-term prediction parameters representing the transfer function of the vocal tract and characteristic of the envelope of the spectrum of the signal. The method used to determine the innovation sequence is the analysis by synthesis method, which may be summarized as follows: in the coder, a large number of innovation sequences from the fixed excitation dictionary are filtered by the LPC filter (the synthesis filter of the functional unit 34 in FIG. 3). Adaptive excitation has been obtained beforehand in a similar manner. The waveform selected is that producing the synthetic signal closest to the original signal (minimizing the error at the level of the functional unit 35) when judged against a perceptual weighting criterion generally known as the CELP criterion (36).

In the FIG. 3 block diagram of the CELP coder, the fundamental frequency ("pitch") of voiced sounds is extracted from the signal resulting from the LPC analysis in the functional unit 31 and thereafter enables the long-term correlation, called the harmonic or adaptive excitation (E.A.) component to be extracted in the functional unit 32. Finally, the residual signal is modeled conventionally by a few pulses, all positions of which are predefined in a directory in the functional unit 33 called the fixed excitation (E.F.) directory.

Decoding is much less complex than coding. The decoder can obtain the quantizing index of each parameter from the bit stream generated by the coder after demultiplexing. The signal can then be reconstructed by decoding the parameters and applying the synthesis model.

The three embodiments referred to above are described below, beginning with a transform coder of the type shown in FIG. 2.

First Embodiment

Application to a "TDAC" Coder

Figure 4A:
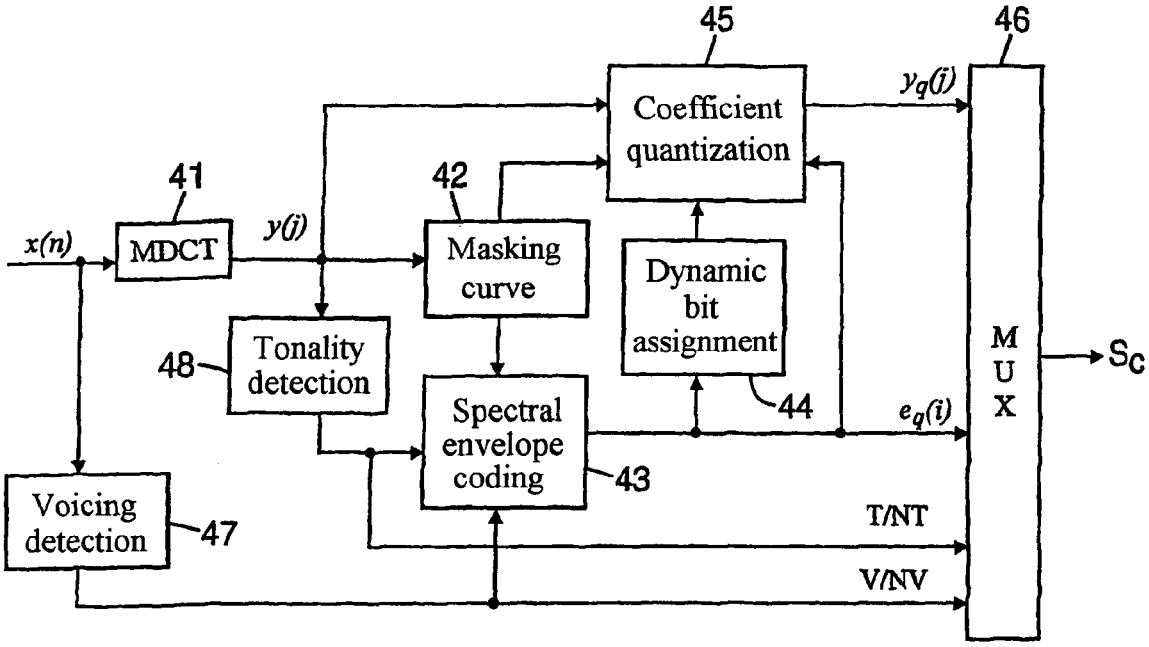
FIG. 4*a* is a diagram of the main functional units of a time domain aliasing cancellation (TDAC) coder.

The first embodiment relates to a "TDAC" perceptual frequency domain coder described in particular in the published document US-2001/027393. A TDAC coder is used to code digital audio signals sampled at 16 kHz (broadened band signals). FIG. 4*a* shows the main functional units of this coder. An audio signal x(n) band-limited to 7 kHz and sampled at 16 kHz is divided into frames of 320 samples (20 ms). A modified discrete cosine transform (MDCT) is applied to the frames of the input signal comprising 640 samples with a 50% overlap, and thus with the MDCT analysis refreshed every 20 ms (functional unit 41). The spectrum is limited to 7225 Hz by setting the last 31 coefficients to zero (only the first 289 coefficients are non-zero). A masking curve is determined from this spectrum (functional unit 42) and all the masked coefficients are set to zero. The spectrum is divided into 32 bands of unequal width. Any masked bands are determined as a function of the transformed coefficients of the signals. The energy of the MDCT coefficients is calculated for each band of the spectrum, to obtain scaling factors. The 32 scaling factors constitute the spectral envelope of the signal, which is then quantized, coded by entropic coding (in functional unit 43) and finally transmitted in the coded frame $s_c$.

Figure 4B:
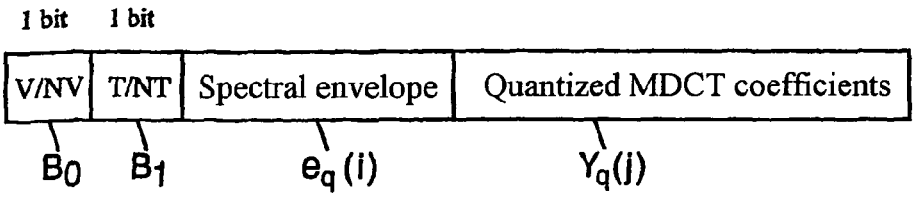
FIG. 4*b* is a diagram of the format of the bit stream coded by the FIG. 4*a* coder.

Dynamic bit assignment (in functional unit 44) is based on a masking curve for each band calculated from the decoded and dequantized version of the spectral envelope (functional unit 42). This makes bit assignment by the coder and the decoder compatible. The normalized MDCT coefficients in each band are then quantized (in functional unit 45) by vector quantizers using size-interleaved dictionaries consisting of a union of type II permutation codes. Finally, referring to FIG. 4*b*, the information on the tonality (here coded on one bit $B_1$) and the voicing (here coded on one bit $B_0$), the spectral envelope $e_q(i)$ and the coded coefficients $y_q(j)$ are multiplexed (in functional unit 46, see FIG. 4*a*) and transmitted in frames.

This coder is able to operate at several bit rates and it is therefore proposed to produce a multiple bit rate coder, for example a coder offering bits rates of 16, 24 and 32 kbps. In this coding scheme, the following functional units may be pooled between the various modes:

- MDCT (functional unit 41);
- voicing detection (functional unit 47, FIG. 4*a*) and tonality detection (functional unit 48, FIG. 4*a*);
- calculation, quantization and entropic coding of the spectral envelope (functional unit 43); and
- calculation of a masking curve coefficient by coefficient and of a masking curve for each band (functional unit 42).

These units account for 61.5% of the complexity of the processing performed by the coding process. Their factorization is therefore of major interest in terms of reducing complexity when generating a plurality of bit streams corresponding to different bit rates.

The results from the above functional units already yield a first portion common to all the output bit streams that contain the bits carrying information on voicing, tonality and the coded spectral envelope.

In a first variant of this embodiment, it is possible to carry out the bit assignment and quantization operations for each of the output bit streams corresponding to each of the bit rates considered. These two operations are carried out in exactly the same way as is usually done in a TDAC coder.

Figure 5:
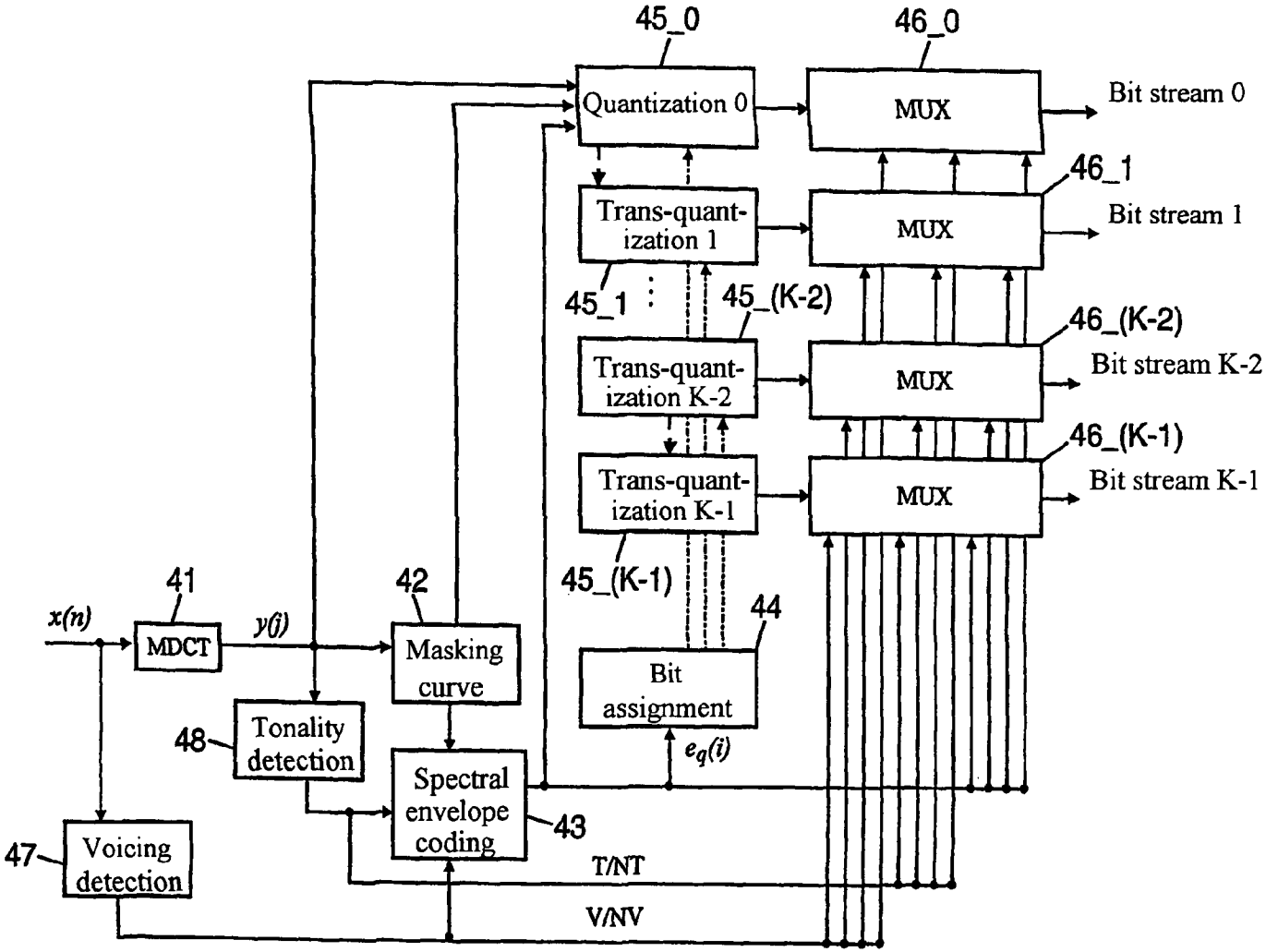
FIG. 5 is a diagram of an advantageous embodiment of the invention applied to a plurality of TDAC coders in parallel.

In a second, more advanced variant, shown in FIG. 5, "intelligent" transcoding techniques may be used (as described in the published document US-2001/027393 cited above) to reduce complexity further and to mutualize certain operations, in particular:

- bit assignment (functional unit 44); and
- coefficient quantization (functional units 45_*i*, see below).

In FIG. 5, the functional units 41, 42, 47, 48, 43 and 44 shared between the coders ("mutualized") carry the same reference numbers as those of a single TDAC coder as shown in FIG. 4*a*. In particular, the bit assignment functional unit 44 is used in multiple passes and the number of bits assigned is adjusted for the transquantization that each coder effects (functional units 45_1, . . . , 45_(K−2), 45_(K−1), see below). Note further that these transquantizations use the results obtained by the quantization functional unit 45_0 for a selected coder of index 0 (the coder with the lowest bit rate in the example described here). Finally, the only functional units of the coders that operate with no real interaction are the multiplexing functional units 46_0, 46_1, . . . , 46_(K−2), 46_(K−1), although they all use the same voicing and tonality information and the same coded spectral envelope. In this regard, suffice to say that partial mutualization of multiplexing may again be effected.

For the bit assignment and quantization functional units, the strategy employed consists in exploiting the results from the bit assignment and quantization functional units obtained for the bit stream (0), at the lowest bit rate $D_0$, to accelerate the operation of the corresponding two functional units for the K−1 other bit streams (k) ($1 \leqq k < K$). A multiple bit rate coding scheme that uses a bit assignment functional unit for each bit stream (with no factorization for that unit) but mutualizes some of the subsequent quantization operations may also be considered.

The multiple coding techniques described above are advantageously based on intelligent transcoding to reduce the bit rate of the coded audio stream, generally in a node of the network.

The bit streams k ($0 \leqq k < K$) are classified in increasing bit rate order ($D_0 < D_1 < \ldots < D_{K-1}$) below. Thus bit stream 0 corresponds to the lowest bit rate.

Bit Assignment

Bit assignment in the TDAC coder is effected in two phases. Firstly, the number of bits to assign to each band is calculated, preferably using the following equation:

$$b_{opt}(i) = \frac{1}{2}\log_2\left[\frac{e_q^2(i)}{S_b(j)}\right] + C,\ 0 \le i \le M-1,$$

in which $$C = \frac{B}{M} - \frac{1}{2M}\sum_{l=0}^{M-1}\log_2[e_q^2(l)/S_b(l)]$$

is a constant,

B is the total number of bits available,

M is the number of bands, $e_q(i)$ is the decoded and dequantized value of the spectral envelope over the band i, and $S_b(i)$ is the masking threshold for that band.

Each of the values obtained is rounded off to the nearest natural integer. If the total bit rate assigned is not exactly equal to that available, a second phase effects an adjustment, preferably by means of a succession of iterative operations based on a perceptual criterion that adds bits to or removes bits from the bands.

Accordingly, if the total number of bits distributed is less than that available, bits are added to the bands showing the greatest perceptual improvement, as measured by the variation of the noise-to-mask ratio between the initial and final band assignments. The bit rate is increased for the band showing the greatest variation. In the contrary situation where the total number of bits distributed is greater than that available, the extraction of bits from the bands is the dual of the above procedure.

In the multiple bit rate coding scheme corresponding to the TDAC coder, it is possible to factorize certain operations for the assignment of bits. Thus the first phase of determination using the above equation may be effected once only based on the lowest bit rate $D_0$. The phase of adjustment by adding bits may then be effected continuously. Once the total number of bits distributed reaches the number corresponding to a bit rate of a bit stream k (k=1, 2 . . . , K−1), the current distribution is considered to be that used for quantizing normalized coefficient vectors for each band of that bit stream.

Coefficient Quantization

For coefficient quantization, the TDAC coder uses vector quantization employing size-interleaved dictionaries consisting of a union of type II permutation codes. This type of quantization is applied to each of the vectors of the MDCT coefficients over the band. This kind of vector is normalized beforehand using the dequantized value of the spectral envelope over that band. The following notation is used:

$C(b_i,d_i)$ is the dictionary corresponding to the number of bits $b_i$ and the dimension $d_i$;

$N(b_i,d_i)$ is the number of elements in that dictionary;

$CL(b_i,d_i)$ is the set of its leaders; and $NL(b_i,d_i)$ is the number of leaders.

The quantization result for each band i of the frame is a code word $m_i$ transmitted in the bit stream. It represents the index of the quantized vector in the dictionary calculated from the following information:

the number $L_i$ in the set $CL(b_i,d_i)$ of the leaders of the dictionary $C(b_i,d_i)$ of the quantized leader vector $\tilde{Y}_q(i)$ nearest a current leader $\tilde{Y}(i)$;

the rank $r_i$ of $Y_q(i)$ in the class of the leader $\tilde{Y}_q(i)$; and the combination of signs $sign_q(i)$ to be applied to $Y_q(i)$ (or to $\tilde{Y}_q(i)$).

The following notation is used:

Y(i) is the vector of the absolute values of the normalized coefficients of the band i;

sign(i) is the vector of the signs of the normalized coefficients of the band i;

$\tilde{Y}(i)$ is the leader vector of the vector Y(i) cited above obtained by ordering its components in decreasing order (the corresponding permutation is denoted perm(i)); and $Y_q(i)$ is the quantized vector of Y(i) (or "the nearest neighbor" of Y(i) in the dictionary $C(b_i,d_i)$).

Below, the notation $\alpha^{(k)}$ with an exponent k indicates the parameter used in the processing effected to obtain the bit stream of the coder k. Parameters without this exponent are calculated once and for all for the bit stream 0. They are independent of the bit rate (or mode) concerned.

The "interleaving" property of the dictionaries referred to above is expressed as follows:

$$C(b_i^{(0)},d_i)\subseteq \ldots \subseteq C(b_i^{(k-1)},d_i)\subseteq C(b_i^{(k)},d_i) \ldots \subseteq C(b_i^{(K-1)},d_i)$$

also with:

$$CL(b_i^{(0)},d_i)\subseteq \ldots \subseteq CL(b_i^{(k-1)},d_i)\subseteq CL(b_i^{(k)},d_i) \ldots \subseteq CL(b_i^{(K-1)},d_i)$$

$CL(b_i^{(k)},d_i)\backslash CL(b_i^{(k-1)},d_i)$ is the complement of $CL(b_i^{(k-1)},d_i)$ in $CL(b_i^{(k)},d_i)$. Its cardinal is equal to $NL(b_i^{(k)},d_i)-NL(b_i^{(k-1)},d_i)$.

The code words $m_i^{(k)}$ (with $0\leqq k<K$), which are the results of quantizing the vector of the coefficients of the band i for each of the bit streams k, are obtained as follows.

For the bit stream k=0, the quantizing operation is effected conventionally, as is usual in the TDAC coder. It produces the parameters $sign_q^{(0)}(i)$, $L_i^{(0)}$ and $r_i^{(0)}$ used to construct the code word $m_i^{(0)}$. The vectors $\tilde{Y}(i)$ and sign(i) are also determined in this step. They are stored in memory, together with the corresponding permutation perm(i), to be used, if necessary, in subsequent steps relating to the other bit streams.

For the bit streams $1\leqq k<K$, an incremental approach is adopted, from k=1 to k=K−1, preferably using the following steps:

If $(b_i^{(k)}=b_i^{(k-1)})$ then:

1. the code word, over the band i, of the frame of the bit stream k is the same as that of the frame of the bit stream (k−1):

$$m_i^{(k)}=m_i^{(k-1)}$$

If not, i.e. if $(b_i^{(k)}>b_i^{(k-1)})$:

2. The leaders $(NL(b_i^{(k)},d_i)-NL(b_i^{(k-1)},d_i))$ of $CL(b_i^{(k)},d_i)\backslash CL(b_i^{(k-1)},d_i)$ are searched for the nearest neighbor of $\tilde{Y}(i)$.
3. Given the result of step 2, and knowing the nearest neighbor of $\tilde{Y}(i)$ in $CL(b_i^{(k-1)},d_i)$, a test is executed to determine if the nearest neighbor of $\tilde{Y}(i)$ in $CL(b_i^{(k)},d_i)$ is in $CL(b_i^{(k-1)},d_i)$ (this is the situation "Flag=0" discussed below) or $CL(b_i^{(k)},d_i)\backslash CL(b_i^{(k-1)},d_i)$ (this is the situation "Flag=1" discussed below).
4. If Flag=0 (the nearest leader of $\tilde{Y}(i)$ in $CL(b_i^{(k-1)},d_i)$ is also its nearest neighbor in $CL(b_i^{(k)},d_i)$) then:

$$m_i^{(k)}=m_i^{(k-1)}$$

If Flag=1 (the leader nearest $\tilde{Y}(i)$ in $CL(b_i^{(k)},d_i)\backslash CL(b_i^{(k-1)},d_i)$ found in step 2 is also its nearest neighbor in $CL(b_i^{(k)},d_i)$), let $L_i^{(k)}$ be its number (with $L_i^{(k)}\geqq NL(b_i^{(k-1)},d_i)$), then the following steps are executed:

a. Search for the rank $r_i^{(k)}$ of $Y_q^{(k)}(i)$ (new quantized vector of Y(i) in the class of the leader $\tilde{Y}_q^{(k)}(i)$, for example using the Schalkwijk algorithm using perm(i);

b. Determine $sign_q^{(k)}(i)$ using sign(i) and perm(i);

c. Determine the code word $m_i^{(k)}$ from $L_i^{(k)}$, $r_i^{(k)}$ and $sign_q^{(k)}(i)$.

Second Embodiment

Application to an MPEG-1 Layer I&II Transform Coder

Figure 6A:
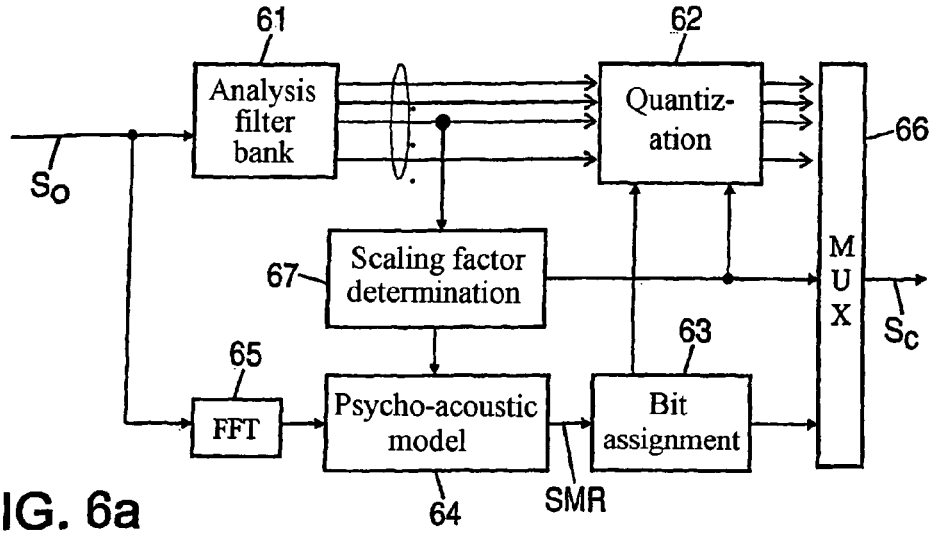
FIG. 6*a* is a diagram of the main functional units of an MPEG-1 (layer I and II) coder.
Figure 6B:
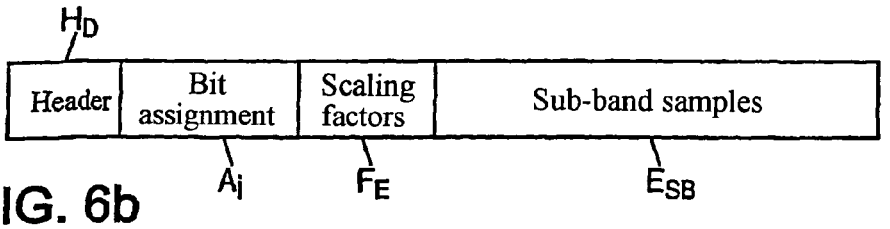
FIG. 6*b* is a diagram of the format of the bit stream coded by the FIG. 6*a* coder.

The MPEG-1 Layer I&II coder shown in FIG. 6*a*, uses a bank of filters with 32 uniform sub-bands (functional unit 61 in FIG. 6*a*) and 6*a*) to apply the time/frequency transform to the input audio signal $s_0$. The output samples of each sub-band are grouped and then normalized by a common scaling factor (determined by the functional unit 67) before being quantized (functional unit 62). The number of levels of the uniform scalar quantizer used for each sub-band is the result of a dynamic bit assignment procedure (carried out by the functional unit 63) that uses a psycho-acoustic model (functional unit 64) to determine the distribution of the bits that renders the quantizing noise as imperceptible as possible. The hearing models proposed in the standard are based on the estimate of the spectrum obtained by applying a fast Fourier transform (FFT) to the time-domain input signal (functional unit 65). Referring to FIG. 6*b*, the frame $s_c$ multiplexed by the functional unit 66 in FIG. 6*a* that is finally transmitted contains, after an header field $H_D$, all the samples of the quantized sub-bands $E_{SB}$, which represent the main information, and complementary information used for the decoding operation, consisting of the scaling factor $F_E$ and the bit assignment factor $A_i$.

Starting from this coding scheme, in one application of the invention a multiple bit rate coder may be constructed by pooling the following functional units (see FIG. 7):

Bank of analysis filters 61;

Determination of scaling factors 67;

FFT calculation 65; and

Masking threshold determination 64 using a psycho-acoustic model.

Figure 7:
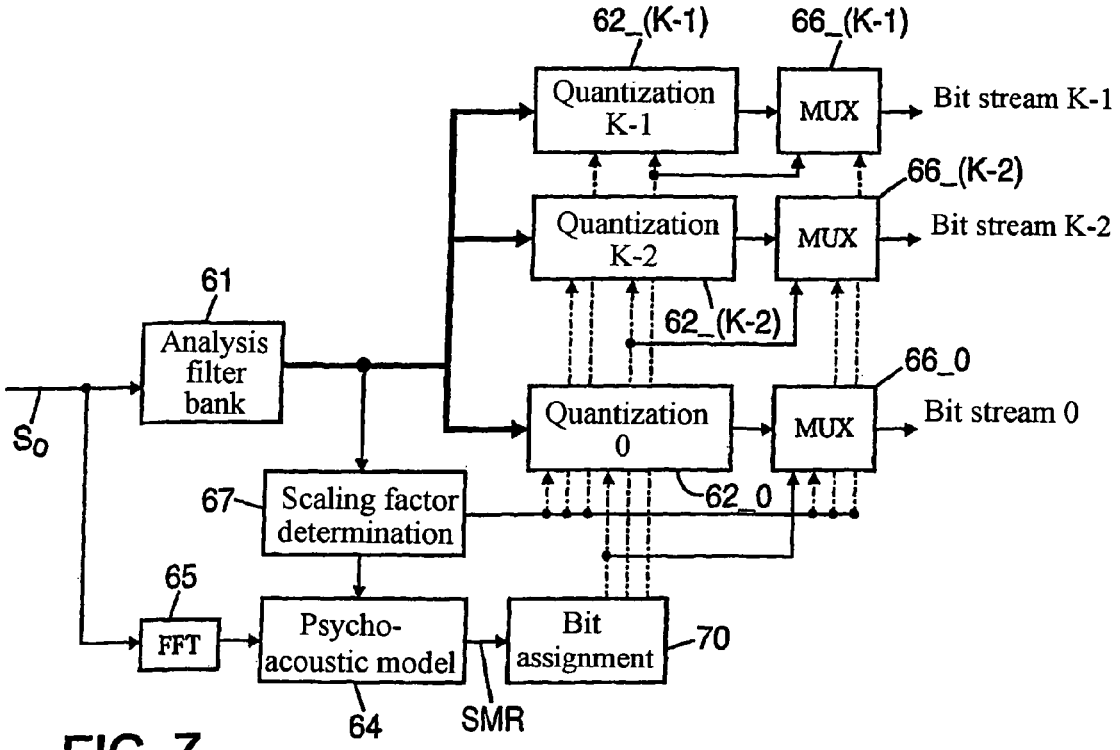
FIG. 7 is a diagram of an advantageous embodiment the invention applied to a plurality of MPEG-1 (layer I and II) coders disposed in parallel.

The functional units 64 and 65 already supply the signal-to-mask ratios (arrows SMR in FIGS. 6*a* and 7) used for the bit assignment procedure (functional unit 70 in FIG. 7).

In the embodiment shown in FIG. 7 it is possible to exploit the procedure used for bit assignment by pooling it but adding a few modifications (bit assignment functional unit 70 in FIG. 7). Only the quantization functional unit 62_0 to 62_(K−1) is then specific to each bit stream corresponding to a bit rate $D_k$ ($0 \leqq k < K-1$). The same applies to the multiplexing unit 66_0 to 66_(K−1).

Bit Assignment

In the MPEG-1 Layer I&II coder, bit assignment is preferably effected by a succession of interactive steps, as follows:

Step 0: Initialize to zero the number of bits $b_i$ for each of the sub-bands i ($0 \leqq i < M$).

Step 1: Update the distortion function NMR(i) (noise-to-mask ratio) over each of the sub-bands $NMR(i)=SMR(i)-SNR(b_i)$, where $SNR(b_i)$ is the signal-to-noise ratio corresponding to the quantizer having a number of bits $b_i$ and SMR(i) is the signal-to-mask ratio supplied by the psycho-acoustic model.

Step 2: Increment the number of bits $b_{i_0}$ of the sub-band $i_0$ where this distortion is at a maximum:

$$b_{i_0} = b_{i_0} + \varepsilon,\ i_0 = \arg\max_i [NMR(i)]$$

where $\epsilon$ is a positive integer value depending on the band, generally taken as equal to 1.

Steps 1 and 2 are iterated until the total number of bits available, corresponding to the operational bit rate, has been distributed. The result of this is a bit distribution vector ($b_0$, $b_1, \ldots, b_{M-1}$).

In the multiple bit rate coding scheme, these steps are pooled with a few other modifications, in particular:

the output of the functional unit consisting of K bit distribution vectors $(b_0^{(k)}, b_1^{(k)}, \ldots, b_{(M-1)}^{(k)}$ $(0 \leqq k \leqq K-1)$, a vector $(b_0^{(k)}, b_1^{(k)}, \ldots, b_{(M-1)}^{(k)}$ is obtained when the total number of bits available corresponding to the bit rate $D_k$ of the bit stream k has been distributed, in the iteration of steps 1 and 2; and the iteration of steps 1 and 2 is stopped when the total number of bits available corresponding to the highest bit rate $D_{K-1}$ has been totally distributed (the bit streams are in order of increasing bit rate).

Note that the bit distribution vectors are obtained successively from k=0 up to k=K−1. The K outputs of the bit assignment functional unit therefore feed the quantization functional units for each of the bit streams at the given bit rate.

Third Embodiment

Application to a CELP Coder

Figure 8:
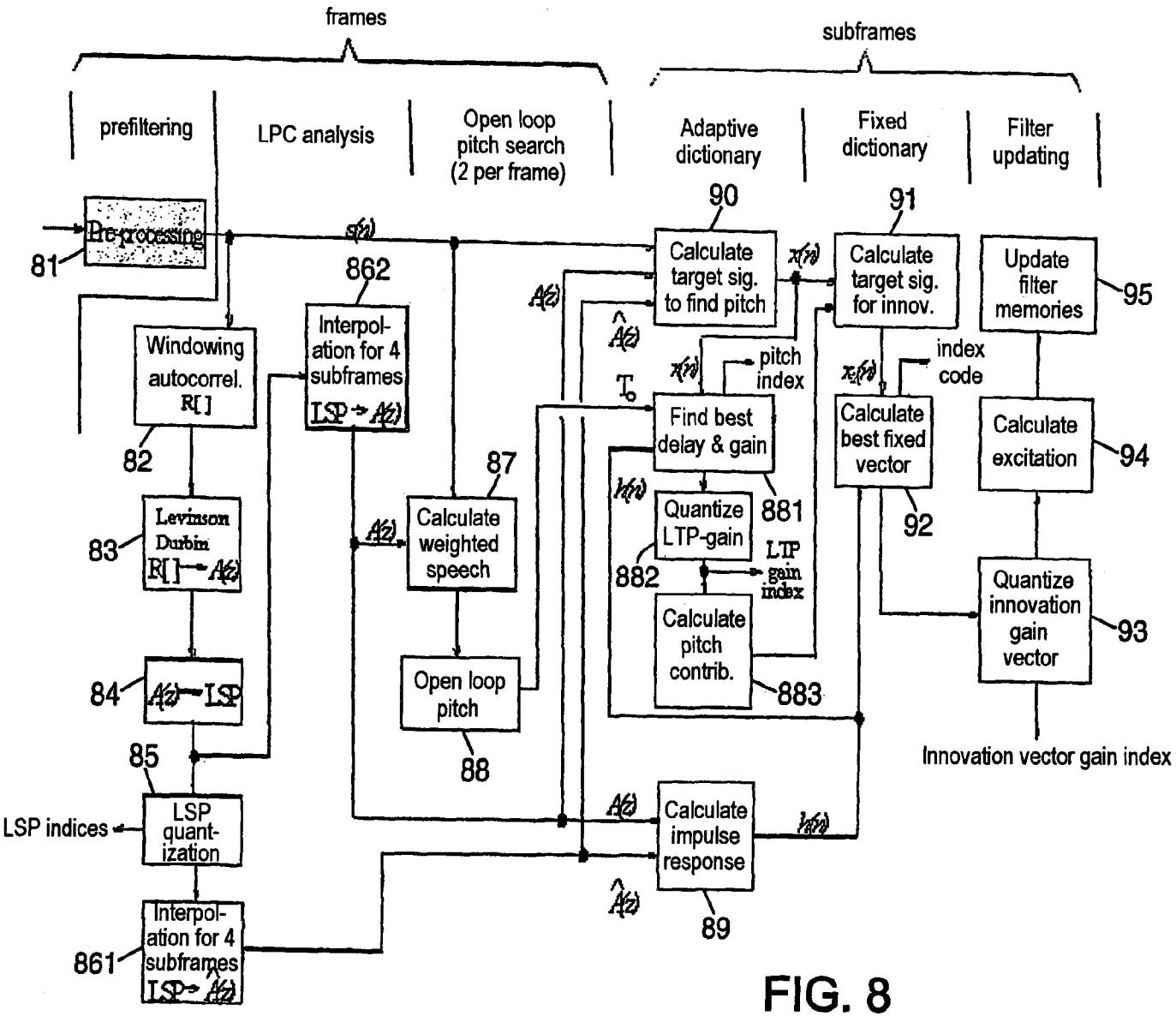
FIG. 8 shows in more detail the functional units of an NB-AMR analysis by synthesis coder conforming to the 3GPP standard.

The final embodiment concerns coding multimode speech using the a posteriori decision 3GPP NB-AMR (Narrow-Band Adaptive Multi-Rate) coder, which is a telephone band speech coder conforming to the 3GPP standard. This coder belongs to the well-known family of CELP coders, the theory of which is described briefly above, and has eight modes (or bit rates) from 12.2 kbps to 4.75 kbps, all based on the algebraic code excited linear prediction (ACELP) technique. FIG. 8 shows the coding scheme of this coder in the form of functional units. This structure has been exploited to produce an a posteriori decision multimode coder based on four NB-AMR modes (7.4; 6.7; 5.9; 5.15).

In a first variant, only mutualization of identical functional units is exploited (the results of the four codings are then identical to those of the four codings in parallel).

In a second variant, the complexity is reduced further. The calculations of functional units that are not identical for certain modes are accelerated by exploiting those of another mode or of a common processing module (see below). The results with the four codings mutualized in this way are then different from those of the four codings in parallel.

In a further variant, the functional units of these four modes are used for multimode trellis coding, as described above with reference to FIG. 1*d*.

The four modes (7.4; 6.7; 5.9; 5.15) of the 3GPP NB-AMR coder are described briefly next.

The 3GPP NB-AMR coder operates on a speech signal band-limited to 3.4 kHz, sampled at 8 kHz and divided into frames of 20 ms (160 samples). Each frame contains four 5 ms subframes (40 samples) grouped two by two into 10 ms "supersubframes" (80 samples). For all the modes, the same types of parameters are extracted from the signal but with variants in terms of the modeling and/or quantization of the parameters. In the NB-AMR coder, five types of parameters are analyzed and coded. The line spectral pair (LSP) parameters are processed once per frame for all modes except the 12.2 mode (and thus once per supersubframe). The other parameters (in particular the LTP delay, adaptive excitation gain, fixed excitation and fixed excitation gain) are processed once per subframe.

The four modes considered here (7.4; 6.7; 5.9; 5.15) differ essentially in terms of the quantization of their parameters. The bit assignment of these four modes is summarized in table 1 below.

TABLE 1

Bit assignment of the four modes (7.4; 6.7; 5.9; 5.15) of the 3GPP NB-AMR coder

| Mode (kbps) | 7.4 | 6.7 | 5.9 | 5.15 |
|---|---|---|---|---|
| LSP | 26 (8 + 9 + 9) | 26 (8 + 9 + 9) | 26 (8 + 9 + 9) | 23 (8 + 8 + 7) |
| LTP delays | 8/5/8/5 | 8/4/8/4 | 8/4/8/4 | 8/4/8/4 |
| Fixed excitation | 17/17/17/17 | 14/14/14/14 | 11/11/11/11 | 9/9/9/9 |
| Fixed and adaptive excitation gains | 7/7/7/7 | 7/7/7/7 | 6/6/6/6 | 6/6/6/6 |
| Total per frame | 148 | 134 | 118 | 103 |

These four modes (7.4; 6.7; 5.9; 5.15) of the NB-AMR coder use exactly the same modules, for example preprocessing, linear prediction coefficient analysis and weighted signal calculation modules. The preprocessing of the signal is low-pass filtering with a cut-off frequency of 80 Hz to eliminate DC components combined with division by two of the input signals to prevent overflows. The LPC analysis comprises windowing submodules, autocorrelation calculation submodules, Levinson-Durbin algorithm implementation submodules, A(z)→LSP transform submodules, submodules for calculating $LSP_i$ non-quantized parameters for each subframe (i=0, . . . , 3) by interpolation between the LSP of the past frame and those of the current frame, and inverse $LSP_i \rightarrow A_i(z)$ transform submodules.

Calculating the weighted speech signal consists in filtering by the perceptual weighting filter ($W_i(z)=A_i(z/\gamma_1)/A_i(z/\gamma_2)$ where $A_i(z)$ is the non-quantized filter of the subframe of index i, $\gamma_1=0.94$ and $\gamma_2=0.6$).

Other functional units are the same for only three of the modes (7.4; 6.7; 5.9). For example, the open loop LTP delay search effected on the weighted signal once per supersubframe for these three modes. For the 5.15 mode, it is effected only once per frame, however.

Similarly, if the four modes used first order predictive weighted vectorial MA (moving average) quantization of with suppressed average and Cartesian product of the LSP parameters in the normalized frequency domain, the LSP parameters of the 5.15 kbps mode are quantized on 23 bits and those of the other three modes on 26 bits. Following transformation into the normalized frequency domain, the "split VQ" vector quantization per Cartesian product of the LSP parameters splits the 10 LSP parameters into three subvectors of size 3, 3 and 4. The first subvector composed of the first three LSP is quantized on 8 bits using the same dictionary for the four modes. The second subvector composed of the next three LSP is quantized for the three high bit rate modes using a dictionary of size 512 (9 bits) and for the 5.15 mode using half of that dictionary (one vector in two). The third and final subvector composed of the last four LSP is quantized for the three high bit rate modes using a dictionary of size 512 (9 bits) and for the lower bit rate mode using a dictionary of size 128 (7 bits). The transformation into the normalized frequency domain, the calculation of the weight of the quadratic error criterion and the moving average (MA) prediction of the LSP residue to be quantized are exactly the same for the four modes. Because the three high bit rate modes use the same dictionaries to quantize the LSP, they can share, in addition to the same vector quantization module, the inverse transform (to revert from the normalized frequency domain to the cosine domain), as well as the calculation of the $LSP^Q_i$ quantized for each subframe (i=0, . . . , 3) by interpolation between the quantized LSP of the past frame and those of the current frame, and finally the inverse transform $LSP^Q_i \rightarrow A^Q_i(z)$ Adaptive and fixed excitation closed loop searches are effected sequentially and necessitate calculation beforehand of the impulse response of the weighted synthesis filter and then of target signals. The impulse response ($A_i(z/\gamma_1)/[A^Q_i(z)\ A_i(z/\gamma_2)]$) of the weighted synthesis filter is exactly the same for the three high bit rate modes (7.4; 6.7; 5.9). For each subframe, the calculation of the target signal for adaptive excitation depends on the weighted signal (independently of the mode), the quantized filter $A^Q_i(z)$ (which is exactly the same for the three modes) and the past of the subframe (which is different for each subframe other than the first subframe). For each subframe, the target signal for fixed excitation is obtained by subtracting from the preceding target signal the contribution of the filtered adaptive excitation of that subframe (which is different from one mode to the other except for the first subframe of the first three modes).

Three adaptive dictionaries are used. The first dictionary, used for the even subframes (i=0 and 2) of the 7.4; 6.7; 5.9 modes and for the first subframe of the 5.15 mode, includes 256 fractional absolute delays of ⅓ resolution in the range [19+⅓.84+⅔] and of entire resolution in the range [85.143]. Searching in this absolute delay dictionary is focused around the delay found in open loop mode (interval of ±5 for the 5.15 mode or ±3 for the other modes). For the first subframe of the 7.4; 6.7; 5.9 modes, the target signal and the open loop delay being identical, the result of the closed loop search is also identical. The other two dictionaries are of differential type and are used to code the difference between the current delay and the entire delay $T_{i-1}$ closest to the fractional delay of the preceding subframe. The first differential dictionary on five bits, used for the odd subframes of the 7.4 mode, is of ⅓ resolution about the entire delay $T_{i-1}$ in the range [$T_{i-1}$−5 +⅔, $T_{i-1}$+4 +⅔]. The second differential dictionary on four bits, which is included in the first differential dictionary, is used for the odd subframes of the 6.7 and 5.9 modes and for the last three subframes of the 5.15 mode. This second dictionary is of entire resolution about the entire delay $T_{i-1}$ in the range [$T_{i-1}$−5, $T_{i-1}$+4] plus a resolution of ⅓ in the range [$T_{i-1}$−1+⅔, $T_{i-1}$+⅔].

The fixed dictionaries belong to the well-known family of ACELP dictionaries. The structure of an ACELP directory is based on the interleaved single-pulse permutation (ISPP) concept, which consists in dividing the set of L positions into K interleaved tracks, the N pulses being located in certain predefined tracks. The 7.4, 6.7, 5.9 and 5.15 modes use the same division of the 40 samples of a subframe into five interlaced tracks of length 8, as shown in Table 2a. Table 2b shows, for the 7.4, 6.7 and 5.9 modes, the bit rate of the dictionary, the number of pulses and their distribution in the tracks. The distributions of the two pulses of the 5.15 mode of the ACELP dictionary with nine bits is even more constrained.

TABLE 2a

Division into interleaved tracks of the 40 positions of a subframe of the 3GPP NB-AMR coder

| Track | Positions |
|---|---|
| $p_0$ | 0, 5, 10, 15, 20, 25, 30, 35 |
| $p_1$ | 1, 6, 11, 16, 21 26, 31, 36 |
| $p_2$ | 2, 7, 12, 17, 22, 27, 32, 37 |
| $p_3$ | 3, 8, 13, 18, 23, 28, 33, 38 |
| $p_4$ | 4, 9, 14, 19, 24, 29, 34, 39 |

TABLE 2b

Distribution of the pulses in the tracks for the 7.4, 6.7 and 5.9 modes of the 3GPP NB-AMR coder

| Mode (kbps) | 7.4 | 6. | 5.9 |
|---|---|---|---|
| ACELP dictionary bit rate | 17 | 14 | 11 |
| (positions + amplitudes) | (13 + 4) | (11 + 3) | (9 + 2) |
| Number of pulses | 4 | 3 | 2 |
| Potential tracks for $i_0$ | $p_0$ | $p_0$ | $p_1$, $p_3$ |
| Potential tracks for $i_1$ | $p_1$ | $p_1$, $p_3$ | $p_0$, $p_1$, $p_2$, $p_4$ |
| Potential tracks for $i_2$ | $p_2$ | $p_2$, $p_4$ | — |
| Potential tracks for $i_3$ | $p_3$, $p_4$ | — | — |

The adaptive and fixed excitation gains are quantized on seven or six bits (with MA prediction applied to the fixed excitation gain) by conjoint vector quantization minimizing the CELP criterion.

Multimode Coding with a Posteriori Decision Exploiting Only Mutualization of Identical Functional Units An a posteriori decision multimode coder may be based on the above coding scheme, pooling the functional units indicated below.

Referring to FIG. 8, there are effected in common for the four modes:

pre-processing (functional unit 81);

analyzing the linear prediction coefficients (windowing and calculating the autocorrelations 82, executing the Levinson-Durbin algorithm 83; A(z)→LSP transform 84, interpolating the LSP and inverse transformation 862);

calculating the weighted input signal 87;

transforming the LSP parameters into the normalized frequency domain, calculating the weight of the quadratic error criterion for vector quantization of the LSP, MA prediction of the LSP residue, vector quantization of the first three LSP (in the functional unit 85).

Thus the cumulative complexity for all these units is divided by four.

For the three highest bit rate modes (7.4, 6.7 and 5.9), there are effected:

vector quantization of the last seven LSP (once per frame) (in functional unit 85 in FIG. 8);

open loop LTP delay search (twice per frame) (functional unit 88);

quantized LSP interpolation (861) and inverse transformation to the filters $A^Q_i$ (for each subframe); and calculation of the impulse response 89 of the weighted synthesis filter (for each subframe).

For these units, the calculations are no longer effected four times but only twice, once for the three highest bit rate modes and once for the low bit rate mode. Their complexity is therefore divided by two.

For the three highest bit rate modes, it is also possible to mutualize for the first subframe the calculation of the target signals for the fixed excitation (functional unit 91 in FIG. 8) and adaptive excitation (functional unit 90), together with the closed loop LTP search (functional unit 881). Note that mutualization of the operations for the first subframe produces identical results only in the context of a posteriori decision multimode type multiple coding. In the general context of multiple coding, the past of the first subframe is different according to the bit rates, as for the other three subframes, these operations generally yielding different results in this case.

Advanced a Posteriori Decision Multimode Coding

Non-identical functional units can be accelerated by exploiting those of another mode or a common processing module. Depending on the constraints of the application (in terms of quality and/or complexity), different variants may be used. A few examples are described below. It is also possible to rely on intelligent transcoding techniques between CELP coders.

Vector Quantization of the Second LSP Subvector

As in the TDAC coder embodiment, interleaving certain dictionaries can accelerate the calculations. Accordingly, as the dictionary of the second LSP subvector of the 5.15 mode is included in that of the other three modes, the quantization of that subvector Y by the four modes can be advantageously combined:

Step 1: Search for nearest neighbor $Y_1$ in the smallest dictionary (corresponding to half the large dictionary)

$Y_1$ quantizes Y for the 5.15 mode

Step 2: Search for the nearest neighbor $Y_h$ in the complement in the large dictionary (i.e. in the other half of the dictionary)

Step 3: Test if the nearest neighbor of Y in the 9-bit dictionary is $Y_1$ ("Flag=0") or $Y_h$ ("Flag=1")

"Flag=0": $Y_1$ also quantizes Y for the 7.4, 6.7 and 5.9 modes

"Flag=1": $Y_h$ quantizes Y for the 7.4, 6.7 and 5.9 modes

This embodiment gives an identical result to non-optimized multimode coding. If quantization complexity is to be reduced further, we can stop at step 1 and take $Y_1$ as the quantized vector for the high bit rate modes if that vector is deemed sufficiently close to Y. This simplification can therefore yield a result different from an exhaustive search.

Open Loop LTP Search Acceleration

The 5.15 mode open loop LTP delay search can use search results for the other modes. If the two open loop delays found over the two supersubframes are sufficiently close to allow differential coding, the 5.15 mode open loop search is not effected. The results of the higher modes are used instead. If not, the options are:

to effect the standard search; or to focus the open loop search on the whole of the frame around the two open loop delays found by the higher modes.

Conversely, the 5.15 mode open loop delay search may also be effected first and the two higher mode open loop delay searches focused around the value determined by the 5.15 mode.

In a third and more advanced embodiment shown in FIG. 1*d*, a multimode trellis coder is produced allowing a number of combinations of functional units, each functional unit having at least two operating modes (or bit rates). This new coder is constructed from the four bit rates (5.15; 5.90; 6.70; 7.40) of the NB-AMR coder cited above. In this coder, four functional units are distinguished: the LPC functional unit, the LTP functional unit, the fixed excitation functional unit and the gains functional unit. With reference to Table 1 above, Table 3a below recapitulates for each of these functional units its number of bit rates and its bit rates.

TABLE 3a

Number of bit rates and bit rates of the functional units for the four modes (5.15; 5.90; 6.70; 7.40) of the NB-AMR coder

| Functional unit | Number of bit rates | Bit rates |
|---|---|---|
| LPC (LSP) | 2 | 26 and 23 |
| LTP delay | 3 | 246, 24 and 20 |
| Fixed excitation | 4 | 68, 56, 44 and 36 |
| Gains | 2 | 28 and 24 |

There are therefore P=4 functional units and 2×3×4×2=48 possible combinations. In this particular embodiment the high bit rate of functional unit 2 (LTP bit rate 26 bits/frame) is not considered. Other choices are possible, of course.

The multiple bit rate coder obtained in this way has a high granularity in terms of bit rates with 32 possible modes (see Table 3b). However, the resulting coder cannot interwork with the NB-AMR coder cited above. In Table 3b, the modes corresponding to the 5.15, 5.90 and 6.70 bit rates of the NB-AMR coder are shown in bold, the exclusion of the highest bit rate of the functional unit LTP eliminating the 7.40 bit rate.

TABLE 3b

Bit rate per functional unit and global bit rate of the multimode trellis coder

| Parameter | LSP | LTP delay | Fixed excitation | Fixed and adaptive excitation gain | Total |
|---|---|---|---|---|---|
| Bit rate per frame | **23** | **20** | **36** | **24** | **103** |
| | 23 | 20 | 36 | 28 | 107 |
| | 23 | 20 | 44 | 24 | 111 |
| | 23 | 20 | 44 | 28 | 115 |
| | 23 | 20 | 56 | 24 | 123 |
| | 23 | 20 | 56 | 28 | 127 |
| | 23 | 20 | 68 | 24 | 135 |
| | 23 | 20 | 68 | 28 | 139 |
| | 23 | 24 | 36 | 24 | 107 |
| | 23 | 24 | 36 | 28 | 111 |
| | 23 | 24 | 44 | 24 | 115 |
| | 23 | 24 | 44 | 28 | 119 |
| | 23 | 24 | 56 | 24 | 127 |
| | 23 | 24 | 56 | 28 | 131 |
| | 23 | 24 | 68 | 24 | 139 |
| | 23 | 24 | 68 | 28 | 143 |
| | 26 | 20 | 36 | 24 | 106 |
| | 26 | 20 | 36 | 28 | 110 |
| | 26 | 20 | 44 | 24 | 114 |
| | 26 | 20 | 44 | 28 | 118 |
| | 26 | 20 | 56 | 24 | 126 |
| | 26 | 20 | 56 | 28 | 130 |
| | 26 | 20 | 68 | 24 | 138 |
| | 26 | 20 | 68 | 28 | 142 |
| | 26 | 24 | 36 | 24 | 110 |
| | 26 | 24 | 36 | 28 | 114 |
| | **26** | **24** | **44** | **24** | **118** |
| | 26 | 24 | 44 | 28 | 122 |
| | 26 | 24 | 56 | 24 | 130 |
| | **26** | **24** | **56** | **28** | **134** |
| | 26 | 24 | 68 | 24 | 142 |
| | 26 | 24 | 68 | 28 | 146 |

This coder having 32 possible bit rates, five bits are necessary for identifying the mode used. As in the previous variant, functional units are mutualized. Different coding strategies are applied to the different functional units.

For example, for functional unit 1 including LSP quantization, preference is given to the low bit rate, as mentioned above, and as follows:

the first subvector made up of the first three LSP is quantized on 8 bits using the same dictionary for the two bit rates associated with this functional unit;

the second subvector made up of the next three LSP is quantized on 8 bits using the dictionary with the lowest bit rate. That dictionary corresponding to half the higher bit rate dictionary, the search is effected in the other half of the dictionary only if the distance between the three LSP and the chosen element in the dictionary exceeds a certain threshold; and the third and final subvector made up of the last four LSP is quantized using a dictionary of size 512 (9 bits) and a dictionary of size 128 (7 bits).

On the other hand, as mentioned above in relation to the second variant (corresponding to multimode coding with advanced a posteriori decision) the choice is made to give preference to the high bit rate for functional unit 2 (LTP delay). In the NB-AMR coder, the open loop LTP delay search is effected twice per frame for the LTP delay of 24 bits and only once per frame for that of 20 bits. The aim is to give preference to the high bit rate for this functional unit. The open loop LTP delay calculation is therefore effected in the following manner:

Two open loop delays are calculated over the two supersubframes. If they are sufficiently close to allow differential coding, the open loop search is not effected over the entire frame. The results for the two supersubframes are used instead; and If they are not sufficiently close, an open loop search is effected over the whole of the frame, focused around the two open loop delays found beforehand. A variant reducing complexity retains only the open loop delay of the first of them.

It is possible to make a partial selection to reduce the number of combinations to be explored after certain functional units. For example, after functional unit 1 (LPC), the combinations with 26 bits can be eliminated for this block if the performance of the 23 bits mode is sufficiently close or the 23 bits mode can be eliminated if its performance is too degraded compared to the 26 bits mode.

Thus the present invention can provide an effective solution to the problem of the complexity of multiple coding by mutualizing and accelerating the calculations executed by the various coders. The coding structures can therefore be represented by means of functional units describing the processing operations effected. The functional units of the different forms of coding used in multiple coding have strong relations that the present invention exploits. Those relations are particularly strong when different codings correspond to different modes of the same structure.

Note finally that from the point of view of complexity the present invention is flexible. It is in fact possible to decide a priori on the maximum multiple coding complexity and to adapt the number of coders explored as a function of that complexity.

The invention claimed is:

1. A method for operating a coding apparatus comprising at least a first coder and a second coder that are interconnected, a processor unit, and a processor unit memory, comprising:

providing a multiple compression coding via a plurality of coding techniques by the interconnected first coder and second coder;

feeding a common input signal in parallel to at least the first and second coder, each coder comprising a succession of functional units for compression coding of said input signal by each of the first and second coders, the first and second coders respectively comprising at least a first and a second shared functional unit for performing common operations;

calculating, by at least a part of the functional units with the processor unit, respective parameters for coding of the input signal by each coder;

performing calculations for delivering, across a coder interconnection, a same set of parameters to the first functional unit and to the second functional unit in a same step and in a shared functional unit for processing of the common input signal by the coders;

if at least one of the first and the second coder operates at a rate that is different from a rate of a common functional unit, adapting the parameters to the respective rate of at least one respective said first coder and said second coder in order to be used by the at least one of said first and second functional unit respectively; and if the first and the second coders operate at a rate that is the same as a rate of the common functional unit, then providing the parameters to the first and second functional units without adaptation.

2. A method according to claim 1, wherein the common functional unit comprises at least one of the function units of one of the first and second coders.

3. A method according to claim 1, further comprising:

identifying the functional units forming each coder and one or more functions implemented by each unit;

marking functions that are common from one coder to another; and executing said common functions in a common calculation module.

4. A method according to claim 3, wherein, for each function executed in the executing step, at least one functional unit is used of a coder selected from said plurality of coders and the functional unit of said coder selected is adapted to deliver partial results to the other coders, for efficient coding by said other coders verifying an optimum criterion between complexity and coding quality.

5. A method according to claim 4, the coders being liable to operate at respective different bit rates, wherein the selected coder is the coder with the lowest bit rate and the results obtained after execution of the function in the executing step with parameters specific to the selected coder are adapted to the bit rates of at least some of the other coders by a focused parameter search for at least some of the other modes up to the coder with the highest bit rate.

6. A method according to claim 5, wherein the functional unit of a coder operating at a given bit rate is used as the calculation module for that bit rate and at least some of the parameters specific to that coder are progressively adapted:

up to the coder with the highest bit rate by focused searching; and down to the coder with the lowest bit rate by focused searching.

7. A method according to claim 4, the coders being adapted to operate at respective different bit rates, wherein the coder selected is the coder with the highest bit rate and the results obtained after execution of the function in the executing step with parameters specific to the selected coder are adapted to the bit rates of at least some of the other coders by a focused parameter search for at least some of the other modes up to the coder with the lowest bit rate.

8. A method according to claim 3, wherein said calculation module is independent of said coders and is adapted to redistribute results obtained in the executing step to all the coders.

9. A method according to claim 8, wherein the independent module and the functional unit or units of at least one of the coders are adapted to exchange results obtained in the executing step with each other and the calculation module is adapted to effect adaptation transcoding between functional units of different coders.

10. A method according to claim 8, wherein the independent module includes a functional unit for performing operations of a coding process and an adaptation transcoding functional unit.

11. A method according to claim 1, wherein the functional units of the various coders are arranged in a trellis with a plurality of possible paths in the trellis, wherein each path in the trellis is defined by a combination of operating modes of the functional units and each functional unit feeds a plurality of possible variants of the next functional unit.

12. A method according to claim 11, wherein a partial selection module is provided after each coding step conducted by one or more functional units capable of selecting the results supplied by one or more of those functional units for subsequent coding steps.

13. A method according to claim 11, the functional units being liable to operate at respective different bit rates using respective parameters specific to said bit rates, wherein, for a given functional unit, the path selected in the trellis is that passing through the lowest bit rate functional unit and the results obtained from said lowest bit rate functional unit are adapted to the bit rates of at least some of the other functional units by a focused parameter search for at least some of the other functional units up to the highest bit rate functional unit.

14. A method according to claim 11, the functional units being liable to operate at respective different bit rates using respective parameters specific to said bit rates, wherein, for a given functional unit, the path selected in the trellis is that passing through the highest bit rate functional unit and the results obtained from said highest bit rate functional unit are adapted to the bit rates of at least some of the other functional units by a focused parameter search for at least some of the other functional units up to the lowest bit rate functional unit.

15. A method according to claim 14, wherein, for a given bit rate associated with the parameters of a functional unit of a coder, the functional unit operating at said given bit rate is used as the calculation module and at least some of the parameters specific to that functional unit are progressively adapted:

down to the functional unit capable of operating at the lowest bit rate by focused searching; and up to the functional unit capable of operating at the highest bit rate by focused searching.

16. A method according to claim 1, wherein the coders in parallel are adapted to operate multimode coding and a posteriori selection module is provided capable of selecting one of the coders.

17. A method according to claim 16, wherein a partial selection module is provided that is independent of the coders and able to select one or more coders after each coding step conducted by one or more functional units.

18. A method according to claim 1, wherein the coders are of the transform type and the calculation module includes a bit assignment functional unit shared between all the coders, each bit assignment effected for one coder being followed by an adaptation to that coder, in particular as a function of its bit rate.

19. A method according to claim 18, wherein the method further includes a quantization step the results whereof are supplied to all the coders.

20. A method according to claim 19, wherein it further includes steps common to all the coders including:

a time-frequency transform;

detection of voicing in the input signal;

detection of tonality;

determination of a masking curve; and spectral envelope coding.

21. A method according to claim 18, wherein the coders affect sub-band coding and the method further includes steps common to all the coders including:

application of a bank of analysis filters;

determination of scaling factors;

spectral transform calculation; and determination of masking thresholds in accordance with a psycho-acoustic model.

22. A method according to claim 1, wherein the coders are of the analysis by synthesis type and the method includes steps common to all the coders including:

preprocessing;

linear prediction coefficient analysis;

weighted input signal calculation; and quantization for at least some of the parameters.

23. A method according to claim 22, wherein:

the coders in parallel are adapted to operate multimode coding and a posteriori selection module is provided capable of selecting one of the coders;

a partial selection module is provided that is independent of the coders and able to select one or more coders after each coding step conducted by one or more functional units; and the partial selection module is used after a split vector quantization step for short-term parameters.

24. A method according to claim 22, wherein:

the coders in parallel are adapted to operate multimode coding and a posteriori selection module is provided capable of selecting one of the coders;

a partial selection module is provided that is independent of the coders and able to select one or more coders after each coding step conducted by one or more functional units; and the partial selection module is used after a shared open loop long-term parameter search step.

25. A non-transitory computer program product, comprising:

a computer readable medium storing a computer program product in memory, said computer readable medium including instructions for implementing a multiple compression coding method for operating a coding apparatus comprising at least a first coder and a second coder that are interconnected, and that both utilize a plurality of coding techniques, the apparatus being fed with a common input signal, said common input signal being inputted in parallel to at least the first and second interconnected coders, each of the first and second coders comprising a succession of functional units, for compression coding of the common input signal by each of the first and second coders, at least a part of said functional units performing calculations for delivering, across a coder interconnection, respective parameters for the coding of the input signal by each coder, the first and second coders respectively comprising at least a first and a second shared functional unit arranged for performing common operations, wherein calculations for delivering a same set of parameters to the first functional unit and to the second functional unit are performed in a same step and in a shared functional unit for processing of the common input signal by the coders, if at least one of the first and the second coder operates at a rate which is different from the rate of said common functional unit, the parameters are adapted to the rate of the respective at least one of the first and second coder in order to be used by the at least one of the respective first and second functional unit; and if the first and the second coders operate at a rate that is the same as a rate of the common functional unit, then the parameters are provided to the first and second functional units without adaptation.

26. A system for assisting multiple compression coding, comprising:

a multiple compression coding apparatus comprising:

at least a first coder and a second coder that are interconnected, the apparatus being fed with a common input signal, said common input signal being inputted in parallel to at least the interconnected first and the second coders, each of the first and second coders comprising a succession of functional units, for compression coding via a plurality of coding techniques of the common input signal by each of the interconnected first and second coders, at least a part of said functional units performing calculations for delivering, across a coder interconnection, respective parameters for the coding of the common input signal by each interconnected coder, the first and second coders respectively comprising at least a first and a second shared functional unit arranged for performing common operations, and a memory storing instructions for implementing by a processor unit a method for operating the system, wherein calculations for delivering a same set of parameters to the first functional unit and to the second functional unit are performed in a same step and in a shared functional unit for processing of the common input signal by the coders, and if at least one of the first and the second coder operates at a rate which is different from the rate of said common functional unit, the parameters are adapted to the rate of the respective at least one of the first and second coder in order to be used by the respective at least one of the first and second functional unit, respectively; and if the first and the second coders operate at a rate that is the same as a rate of the common functional unit, then the parameters are provided to the first and second functional units without adaptation.

27. A system according to claim 26, wherein it further includes an independent calculation module for implementing the following preparatory steps:

identifying the functional units forming each coder and one or more functions implemented by each unit;

marking functions that are common from one coder to another; and executing said common functions in a common calculation module.

28. A multiple compression coding method, comprising:

providing a multiple compression coding via a plurality of coding techniques by a plurality of coders comprising at least a first coder and a second coder that are interconnected;

feeding a common input signal in parallel to an apparatus comprising the plurality of coders, each including a succession of functional units for compression coding of said signal by each coder, wherein each coder comprises a different combination of functional units;

identifying the functional units forming each coder and one or more functions implemented by each unit;

marking functions that are equivalent from one coder to another;

selecting a function executed by a given coder amongst the functions that are equivalent, and executing, via a processor unit, said functions with parameters provided across a coder interconnection related to the given coder only one time for the common input signal for at least some of the interconnected coders in a shared common calculation module;

adapting a result obtained from the execution of the function in the selecting and executing step for a use in at least a part of the plurality of coders; and producing and feeding a coded output signal from the apparatus based at least in part on the common functions.

29. A multiple compression coding method, comprising:

feeding a common input signal in parallel to an apparatus comprising a plurality of coders that are interconnected, each including a succession of functional units for compression coding of said common signal by each coder, wherein each coder comprises a different combination of functional units;

identifying the functional units forming each coder and one or more functions implemented by each unit;

marking functions that are common from one coder to another;

executing, via a processor unit, said common functions only one time for the common input signal for at least some of the coders in a shared common calculation module, based on parameters provided across a coder interconnection; and producing and feeding a coded output signal from the apparatus based at least in part on the common functions;

wherein said calculation module is independent of said coders and is adapted to redistribute results obtained in the executing step to all the coders; and the independent module and the functional unit or units of at least one of the coders are adapted to exchange results obtained in the executing step with each other and the calculation module is adapted to affect adaptation transcoding between functional units of different interconnected coders.

* * * * *